US007991303B2

(12) United States Patent
Hattori

(10) Patent No.: US 7,991,303 B2
(45) Date of Patent: Aug. 2, 2011

(54) IMAGE FORMING APPARATUS

(75) Inventor: Yoshiteru Hattori, Ichinomiya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 339 days.

(21) Appl. No.: 12/389,779

(22) Filed: Feb. 20, 2009

(65) Prior Publication Data

US 2009/0214235 A1 Aug. 27, 2009

(30) Foreign Application Priority Data

Feb. 27, 2008 (JP) ..... 2008-046414

(51) Int. Cl.
*G03G 15/00* (2006.01)

(52) U.S. Cl. ..... 399/9; 399/11; 399/13; 399/114

(58) Field of Classification Search ..... 399/9–13, 399/24, 25, 107, 110–114
See application file for complete search history.

(56) References Cited

U.S. PATENT DOCUMENTS 7,369,783 B2 * 5/2008 Kikuchi ..... 399/12

FOREIGN PATENT DOCUMENTS

| | | |
|---|---|---|
| JP | A-11-95628 | 4/1999 |
| JP | 2002-351283 | 12/2002 |
| JP | 2003-270894 | 9/2003 |

* cited by examiner

*Primary Examiner* — Hoan Tran
(74) *Attorney, Agent, or Firm* — Scully, Scott, Murphy & Presser, P.C.

(57) ABSTRACT

An image forming apparatus includes; a main body; a detachable member; a cover; a displacement member movable between a preventing position and a permitting position; a one-way link mechanism provided for displacing the displacement member from the preventing position to the permitting position when the cover is opened from a state in which the cover is closed and the displacement member is disposed in the preventing position, and for keeping the displacement member in the permitting position when the cover is closed from a state in which the cover is opened; a position detection unit for detecting a position of the displacement member right after a power supply unit has been switched on; and a history determination unit for determining an existence of a history showing an opening and closure of the cover while the power supply unit is left off based on the position of the displacement member.

12 Claims, 26 Drawing Sheets

IMAGE FORMING APPARATUS

CROSS REFERENCE TO RELATED APPLICATION

The present application claims priority from Japanese Patent Application No. 2008-046414, which was filed on Feb. 27, 2008, the disclosure of which is herein incorporated by reference in its entirety.

TECHNICAL FIELD

Apparatuses consistent with the present invention relates to an electro-photographic type image forming apparatus.

BACKGROUND

Japanese unexamined patent application publication No. JP-A-11-95628 describes a related art image forming apparatus.

In the related art image forming apparatus, there is known a so-called tandem type image forming apparatus in which photosensitive drums corresponding respectively to respective colors of yellow, magenta, cyan and black are disposed in parallel.

In the related art tandem type image forming apparatus, developing rollers are provided so as to confront the photosensitive drums, respectively. Electrostatic latent images are formed on surfaces of the photosensitive drums. When the electrostatic latent images face with the corresponding developing rollers in association with rotation of the photosensitive drums, toner is supplied from the developing rollers to the electrostatic latent images, whereby toner images are formed on the surfaces of the photosensitive drums. The toner images of colors corresponding to the respective photosensitive drums are formed thereon, and the toner images of respective colors are transferred on to a sheet that is conveyed by a belt in a superimposed fashion, then, the formation of the full color image on the sheet is attained.

In order to form a full color image with high quality, the toner images of respective colors need to be transferred on to the sheet without any color registration error. Therefore, in the related art tandem type image forming apparatus, toner images of respective colors referred to as registration marks are formed at the same time on a belt which is disposed to confront all the respective photosensitive drums, and a so-called color registration error correction is implemented in which timings at which toner images of respective colors are formed (timings at which electrostatic latent images are formed on the respective photosensitive drums) are corrected such that intervals between the registration marks lying adjacent to each other become predetermined intervals.

A cover is provided on a housing of the image forming apparatus so as to be opened and closed. The cover is sometimes opened to perform servicing for maintenance (for example, replacement of parts and removal of jammed sheets of paper), and when color images are formed thereafter, there is a possibility that a color registration error attributed to the maintenance servicing occurs. Therefore, a configuration is proposed in which a sensor is provided for detecting the opening and closure of the cover (door), and when the sensor detects that the cover has been opened and then closed, a color registration error correction is made to be performed in response to the detection by the sensor. In addition, since the sensor remains out of operation and hence cannot detect the opening and closure of the cover in such a state that the power supply for the image forming apparatus is switched off, there is also proposed a configuration in which a color registration error correction is made to be performed in response to the power supply being switched on.

SUMMARY

However, the related art image forming has a few disadvantages. For example, in the above described configuration in which the color registration error correction is made to be implemented every time the power supply is made on, irrespective of the fact that there is no fear that a color registration error is generated in forming a color image after the power supply is made on when the cover has not been opened and closed with the power supply made off, a color registration error correction is still implemented before a color image is formed. Therefore, some time has to be spent from the power supply has been made on until a color image is started to be formed.

In other words, the color registration error correction is desirably implemented only when the cover has been opened and closed. To do this, it is necessary to determine whether or not the cover was opened and closed during the power supply was left off.

Then, the present invention has been made in view of these situations and an aspect of the present invention is to provide an image forming apparatus which can determine accurately on the existence of a history showing that the cover was opened and closed during the power supply was left off.

Exemplary embodiments of the present invention address the above disadvantages and other disadvantages not described above. However, the present invention is not required to overcome the disadvantages described above, and thus, an exemplary embodiment of the present invention may not overcome any of the problems described above.

According to an exemplary embodiment of the present invention, there is provided an image forming apparatus that is operable in a state in which a power supply unit is switched on, the image forming apparatus comprising; an apparatus main body; a detachable member that is detachably provided in the apparatus main body; a cover that is provided so as to be openable and closable to the apparatus main body, the cover being opened and closed for an attachment and detachment operation of the detachable member; a displacement member that is provided so as to be movable between a preventing position where the displacement member prevents the attachment and detachment operation of the detachable member and a permitting position where the displacement member permits the attachment and detachment operation of the detachable member; a one-way link mechanism that is provided in the apparatus main body for displacing the displacement member from the preventing position to the permitting position when the cover is opened from a state in which the cover is closed and the displacement member is disposed in the preventing position, the one-way link mechanism being provided for keeping the displacement member in the permitting position when the cover is closed from a state in which the cover is opened; a position detection unit for detecting a position of the displacement member right after the power supply unit has been switched on; and a history determination unit for determining an existence of a history showing an opening and closure of the cover while the power supply unit is left off based on the position of the displacement member detected by the position detection unit.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

1. Overall Configuration of Printer

Figure 1:
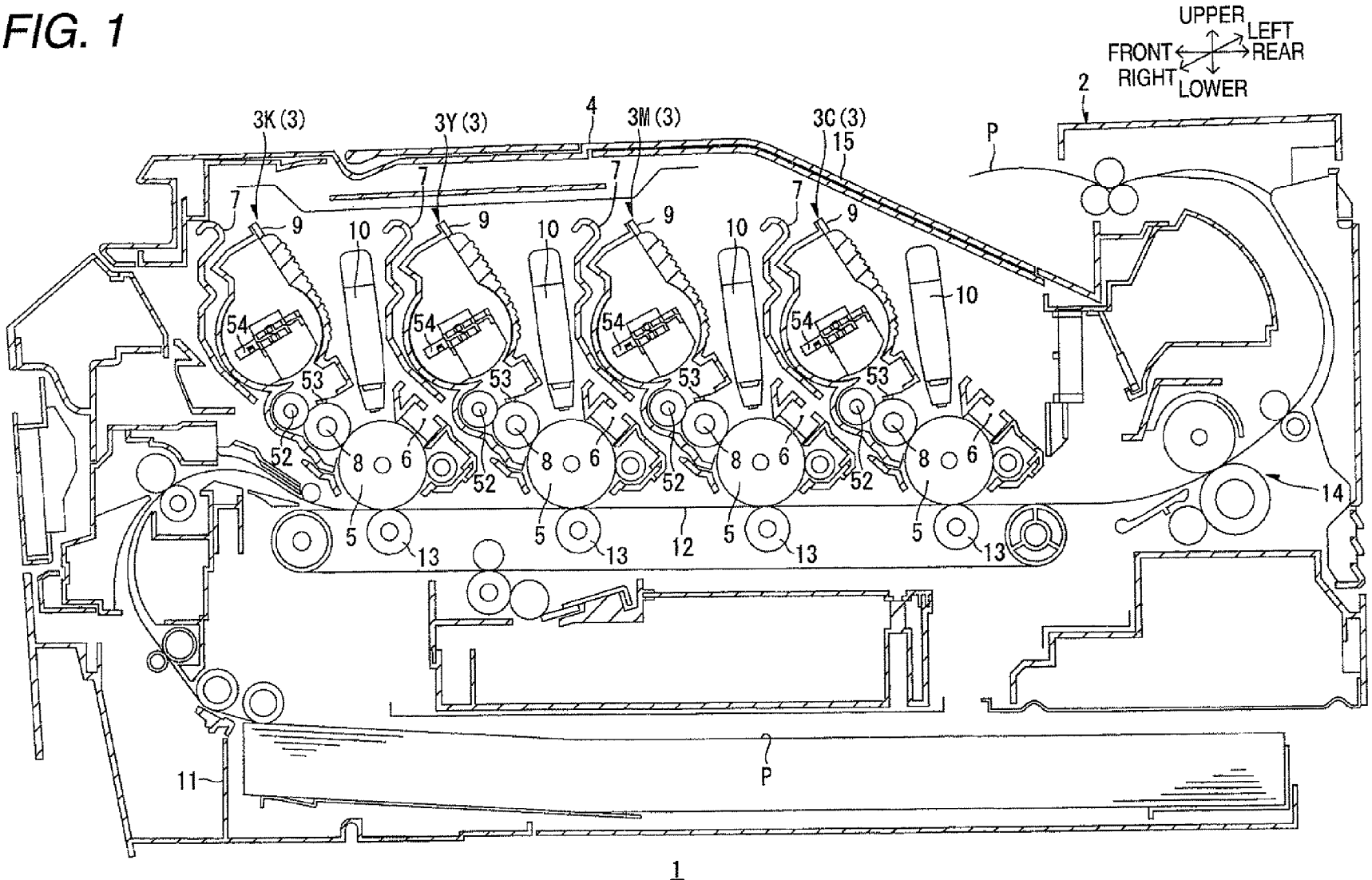
FIG. 1 is a side sectional view of a color printer according to an exemplary embodiment of the present invention.

FIG. 1 is a side sectional view of a color printer according to an exemplary embodiment of the present invention.

A printer 1, which is an example of an image forming apparatus, is a tandem type color printer. Four process cartridges 3, which is an example of detachable members and image forming units, are disposed in parallel within a body casing 2, which is an example of an apparatus main body. The process cartridges 3 are provided so as to correspond respectively to colors of black, yellow, magenta and cyan and are aligned in a conveying direction in which sheets P are conveyed by a conveyer belt 12, which will be described later, in the order of black, yellow, magenta and cyan. The process cartridges 3 can be attached into and detached from an interior of the body casing 2 with a top cover 4, which is an example of a cover, placed on an upper surface of the body casing 2 opened.

Each process cartridge 3 includes a drum cartridge 7 which holds a photosensitive drum 5, which is an example of a photosensitive member, and a scorotron-type charger 6 and a developing cartridge 9 which holds a developing roller 8, which is an example of a developing member. Surface of the photosensitive drums 5 are uniformly charged by the corresponding scorotron-type chargers 6 and are thereafter selectively exposed by light from corresponding LED units 10. By this exposure, electrostatic latent images based on image data are formed on the surfaces of the photosensitive drums 5. When the electrostatic latent images so formed come to confront the corresponding developing rollers 8, toner, which is an example of developer, is supplied to the electrostatic latent images so formed from the developing rollers 8, whereby the electrostatic latent images are visualized by the toner so supplied. By this series of actions, the toner images are formed on the surfaces of the photosensitive drums 5.

A sheet feeding cassette 11 for accommodating sheets P is disposed in a bottom part of the body casing 2. Sheets P stored in the sheet feeding cassette 11 are conveyed onto the conveyer belt 12 by various types of rollers. The conveyor belt 12 is disposed so as to confront the four photosensitive drums 5 from therebelow. Transfer rollers 13 are disposed in positions which confront the photosensitive drums 5 with an upper part of the conveyer belt 12 interposed therebetween. A sheet P that has been conveyed onto the conveyor belt 12 passes sequentially by the respective photosensitive drums 5 while being conveyed between the conveyor belt 12 and the photosensitive drums 5 by the conveyor belt 12 running. In addition, the toner images formed on the surfaces of the photosensitive drums 5 are transferred on to the sheet P by transfer bias applied to transfer rollers 13 when the sheet P come to confront the photosensitive drums 5.

A fixing unit 14 is provided downstream of the conveyer belt 12 in the conveying direction of sheets P. The sheet P onto which the toner images have been transferred is conveyed to the fixing unit 14. The resulting full color toner image transferred on to the sheet P is then heated and pressed in the fixing unit 14 to thereby be fused or fixed on to the sheet P. Thereafter, the sheet P on which the toner image is fixed is discharged on to a sheet discharging tray 15 by various types of rollers.

In addition, when attempting to distinguish a specific process cartridge 3 from the other process cartridges 3 in terms of color, characters denoting the respective colors such as K (black), Y (yellow), M (magenta) and C (cyan) are given to the respective reference numerals at the ends thereof.

Additionally, an upstream side in the conveying direction of sheets P by the conveyor belt 12 is referred to as a front side of the printer 1, based on which left and right sides of the printer 1 when the printer 1 is viewed from the front side are determined. As to the process cartridges 3, in such a state that the process cartridges 3 are placed horizontally, a side where the developing cartridge 9 is disposed is referred to as a front side relative to the photosensitive drum 5, based on which top, bottom, left and right of the process cartridge 3 when it is viewed from the front side may be determined from time to time. In each of FIGS. 1 to 24, arrows indicating directions such as front, back or rear, top or upper, bottom or lower, left and right of the printer 1 are shown.

2. Process Cartridge

Figure 2:
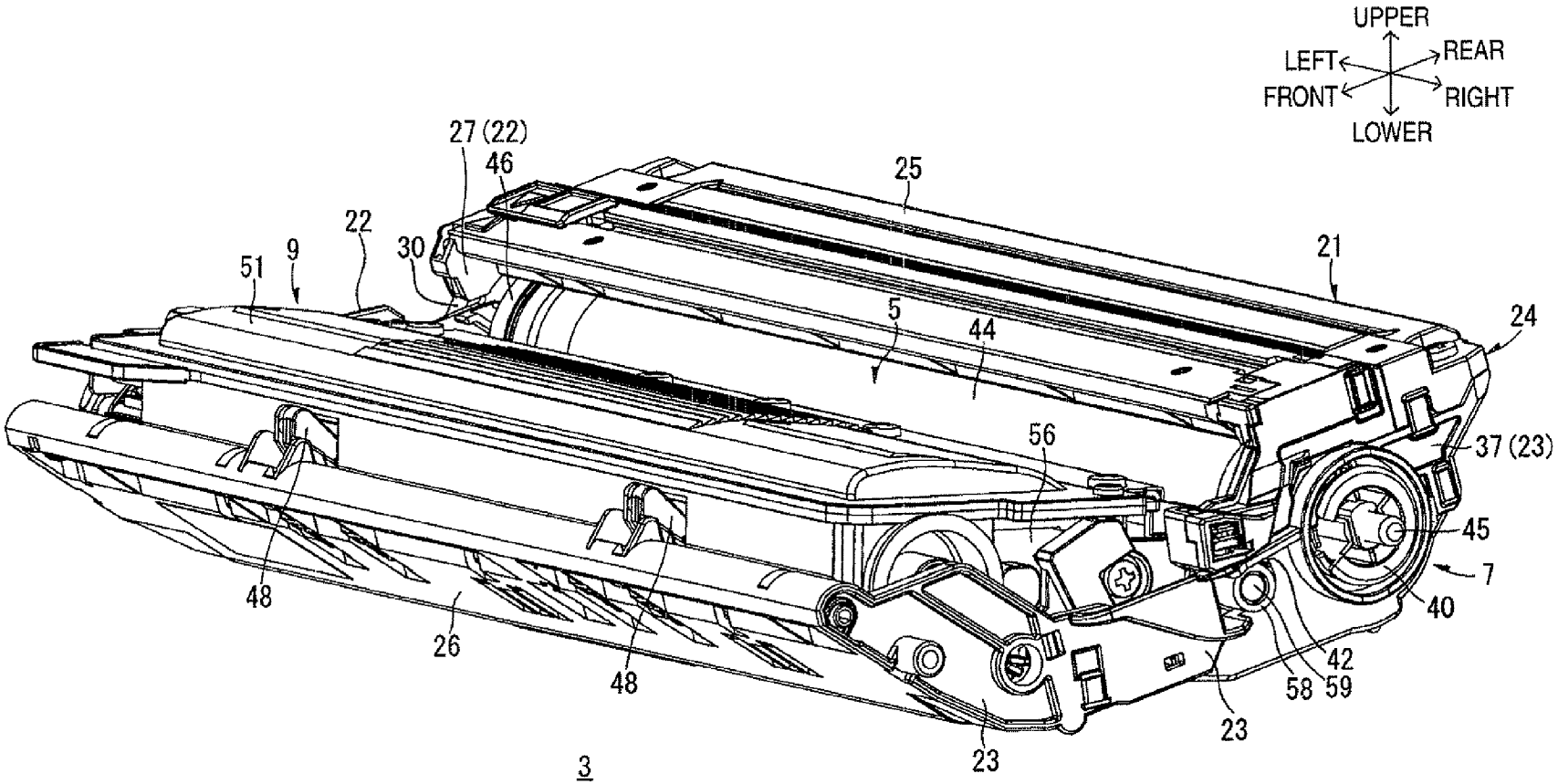
FIG. 2 is a perspective view of a process cartridge as viewed from a right front side.
Figure 3:
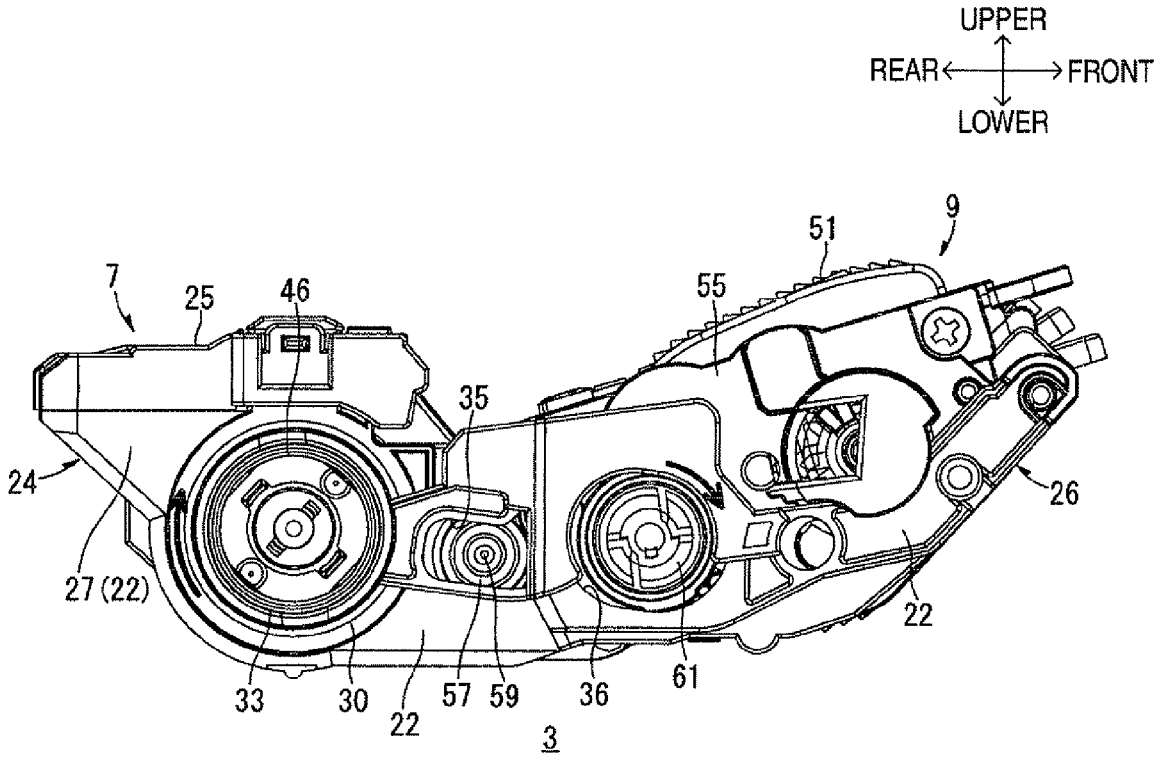
FIG. 3 is a left side view of the process cartridge.

FIG. 2 is a perspective view of the process cartridge as viewed from a right front direction. FIG. 3 is a left side view of the process cartridge.

(1) Drum Cartridge

The drum cartridge 7 includes a drum frame 21. The drum frame 22 has integrally a pair of drum side walls 22, 23, a drum rear wall 24, a drum top wall 25, and a drum front wall 26.

The pair of drum side walls 22, 23 are disposed in a left-right or transverse direction so as to be spaced apart from each other at a predetermined interval provided therebetween.

As shown in FIG. 3, a substantially cylindrical protecting portion 30 is formed at a rear end portion of the left-hand drum side wall 22 so as to project outwards (leftwards). A through hole is formed at a rear portion 27 of the left-hand side wall in a position surrounded by the protecting portion 30, and a left drum bearing 33 is fitted in this through hole.

In addition, a substantially U-shaped mounting guide groove 35 as viewed from the side is formed in the left-hand drum side wall 22 in a position lying forwards of the protecting portion 30 so as to open to the rear.

Further, an elongated hole 36, in which a longitudinal diameter is slightly longer than a vertical diameter, is formed in a left-hand drum side wall 22 in a position lying forwards of the mounting guide groove 35.

As shown in FIG. 2, a right drum bearing 40 is attached to a rear end portion of the right-hand drum side wall 23.

In addition, a substantially U-shaped mounting guide groove 42 as viewed from the side is formed in the right-hand drum side wall 23 in a position which confronts transversely the mounting guide groove 35 in the left-hand drum side wall 22 so as to open to the rear.

The photosensitive drum 5 is disposed between the left drum bearing 33 attached to the left-hand drum side wall 22 and the right drum bearing 40 attached to the right-hand drum side wall 23. The photosensitive drum 5 includes a cylindrical drum main body 44 and a drum shaft 45 which extends along a center axis of the drum main body 44. Flange members 46 (a right-hand flange member 46 is not shown) are fixed respectively to both end portions of the drum main body 44, and the drum shaft 45 is inserted into the respective flange members 46 along a center thereof so as to rotate relative to the flange members 46. A right end portion of the drum shaft 45 is inserted into the right drum bearing 40 so as not to rotate relative thereto and projects rightwards from the right drum bearing 40. On the other hand, the flange member 46 which is fixed to the left end portion of the drum main body 44 is held so as to rotate relative to the left drum bearing 33. By this configuration, the drum main body 44 of the photosensitive drum 5 is provided between the left-hand side wall rear portion 27 and a right-hand side wall rear portion 37 so as to rotate about the drum shaft 45.

The drum rear wall 24 is provided so as to extend between respective rear ends of the drum side walls 22, 23.

The drum top wall 25 is provided so as to extend between upper ends of the respective rear end portions of the drum side walls 22, 23.

The drum front wall 26 is provided so as to extend between front ends of the drum side walls 22, 23 and is formed so as to be inclined obliquely upwards as it extends forwards. Pressing levers 48 are provided on the drum front wall 26 in two locations which lie to confront each other in the transverse direction across a center portion thereof for pressing the developing cartridge 9 towards the photosensitive drum 5.

(2) Developing Cartridge

As shown in FIG. 2, the developing cartridge 9 is disposed in a space defined by the drum side walls 22, 23 and the drum front wall 26 in such a state that the developing cartridge 9 is attached to the drum cartridge 7.

The developing cartridge 9 includes a housing 51. The housing 51 has a box shape which is opened at its rear side. The housing 51 holds therein the developing roller 8, a supply roller 52, a layer thickness regulating blade 53 and an agitator 54 (refer to FIG. 1). In addition, toner is accommodated in the housing 51.

The developing roller 8 is disposed so as to be exposed to the rear from the housing 51 and is supported rotatably on both side walls 55, 56 of the housing 51. Specifically, substantially cylindrical developing bearing members 57, 58 are provided at respective rear end portions of the side walls 55, 56 so as to project outwards. The developing bearing members 57, 58 are disposed in positions which confront each other in the transverse direction. The developing roller 8 has a configuration in which a metallic developing roller shaft 59 is covered with a rubber roller made of a conductive rubber. In addition, the developing roller 8 is rotatably supported on the side walls 55, 56 by both end portions of the developing roller shaft 59 being rotatably inserted into the developing bearing members 57, 58.

In addition, as shown in FIG. 3, a developing passive gear 61 into which a driving force of the developing roller 8 is inputted is provided at the rear of the developing bearing member 57 on the left-hand side wall 55 of the housing 51. This developing passive gear 61 confronts the elongated hole 36 formed in the left-hand drum side wall 22 of the drum cartridge 7 in such a state that the developing cartridge 9 is attached to the drum cartridge 7.

(3) Attachment of Developing Cartridge to Drum Cartridge

The developing cartridge 9 is attached to the drum cartridge 7 from the front of the photosensitive drum 5. In attaching the developing cartridge 9 to the drum cartridge 7 in this way, firstly, the developing bearing members 57, 58 are fitted in the corresponding mounting guide grooves 35, 42, respectively. Then, by the developing cartridge 9 being pushed rearwards, the developing cartridge 9 moves rearwards while the developing bearing members 57, 58 are being guided rearwards by the corresponding mount guiding grooves 35, 42, respectively. During the movement of the developing cartridge 9 in this way, the housing 51 of the developing cartridge 9 is brought into abutment with the pressing levers 48, and by the housing 51 being pushed downwards against the pressure of the pressing levers 48, the attachment of the developing cartridge 9 to the drum cartridge 7 is completed. In this state, in the developing cartridge 9, the developing roller 8 is brought into press contact with the photosensitive drum 5 by virtue of the pressing force (the pressing force) of the pressing levers 48.

3. Body Frame

Figure 4:
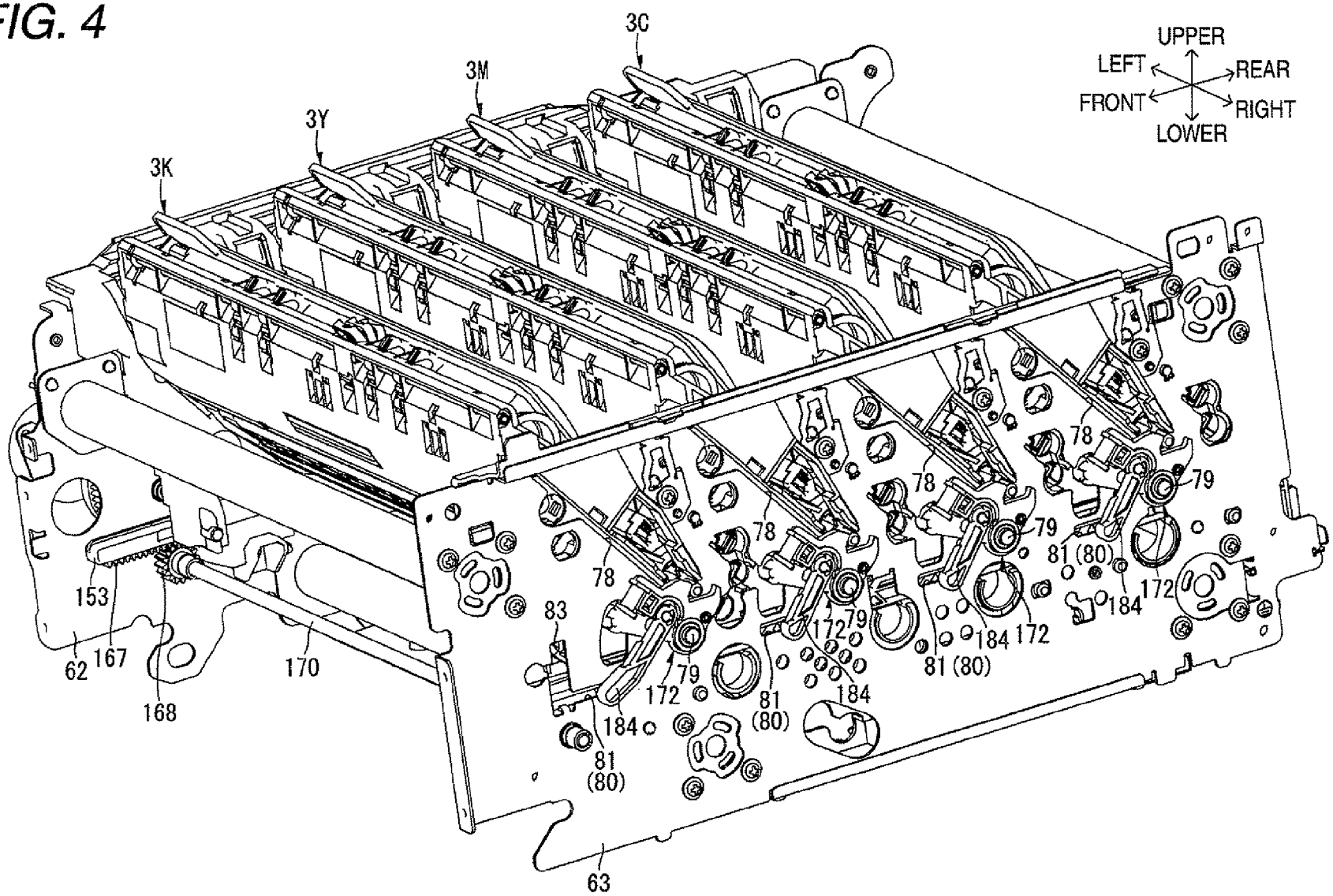
FIG. 4 is a perspective view showing an interior of a body casing 2 as viewed from the right front side thereof.

FIG. 4 is a perspective view showing an interior of the body casing 2 as viewed from the right front direction thereof.

A pair of body frames 62, 63 is disposed such that the body frames confront each other in a right-left or transverse direction with a predetermined interval provided therebetween. The respective body frames 62, 63 are made of a sheet metal and have a substantially rectangular shape as viewed from the side. A black process cartridge 3K, a yellow process cartridge 3Y, a magenta process cartridge 3M and a cyan process cartridge 3C are installed between the body frames 62, 63.

(1) Left-Hand Body Frame

Figure 5:
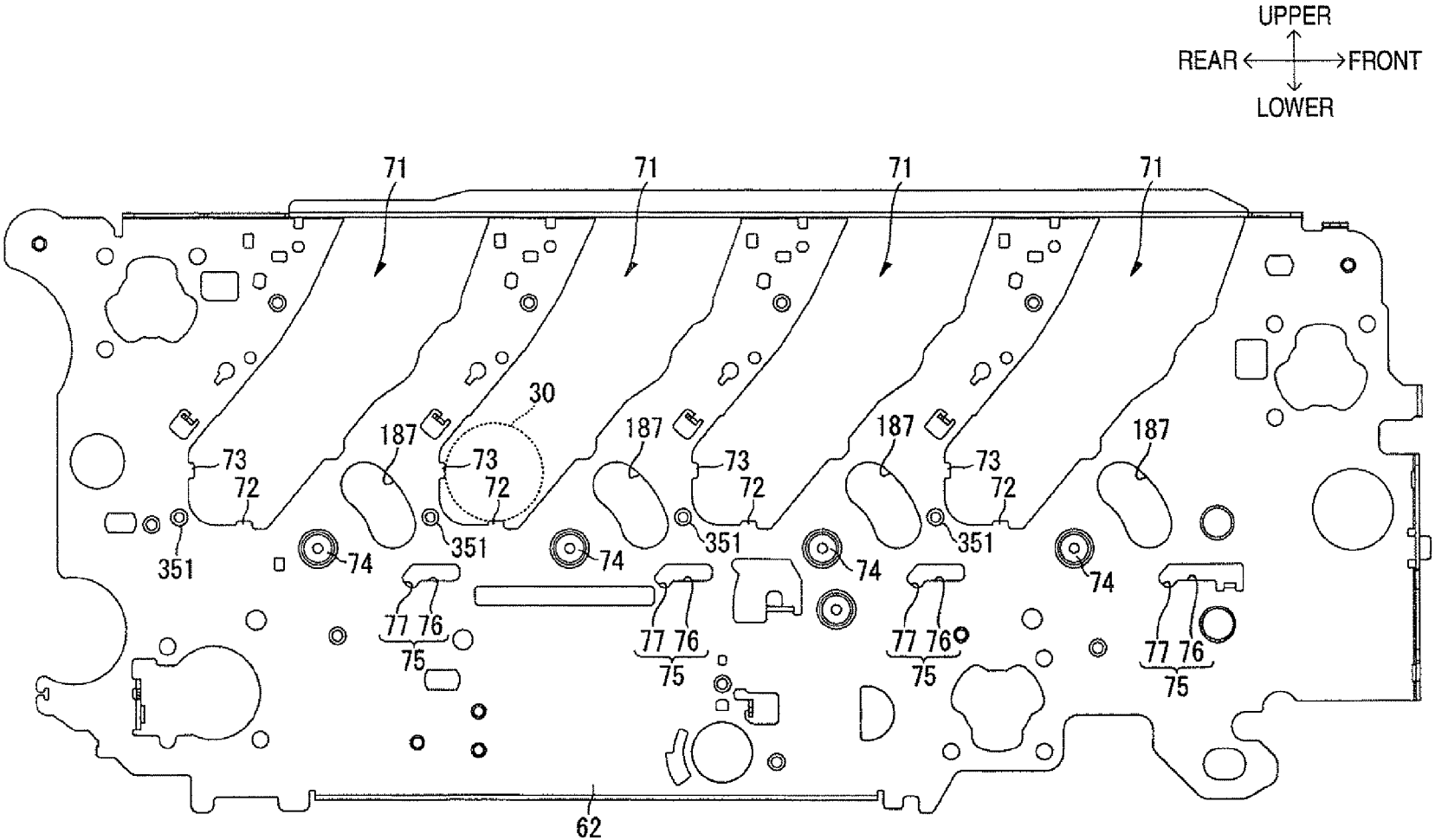
FIG. 5 is a left side view of a left-hand body frame.

FIG. 5 is a left side view of the left-hand body frame.

Four process guide grooves 71 are formed in the left-hand body frame 62. Each process guide groove 71 is formed by cutting out the body frame 62 from an upper edge thereof, has a width corresponding to an outside diameter of the protecting portion 30 formed on the drum frame 21 and extends obliquely downwards and rearwards from the upper edge to a vertically central portion of the body frame 62. A first abutment portion 72 having a rectangular shape as viewed from the side and projecting upwards in the process guide groove 71 and a second abutment portion 73 having a substantially rectangular shape as viewed from the side and projecting forwards in the process guide groove 71 are formed at a lower end portion of each of the process guide grooves 71. The four process guide grooves 71 are formed at equal intervals in a front-back or longitudinal direction.

In addition, on the body frame 62, cylindrical projecting portions 74 which project leftwards are provided respectively in positions which lie spaced apart obliquely downwards and forwards from the lower end portions of the corresponding process guide grooves 71.

Further, on the body frame 62, guide holes 75 which penetrate through the body frame 62 are provided respectively in positions which lie spaced apart forwards and slightly obliquely downwards relative to the corresponding projecting portions 74. Each guide hole 75 has a straight hole portion 76 which extends in the longitudinal direction and an intersecting hole portion 77 which extends obliquely downwards and rearwards from a rear end of the straight hole portion 76. The straight hole portion 76 of the frontmost guide hole 75 is formed longer than the straight hole portions 76 of the other guide holes 75.

In addition, on the body frame 62, arc-shaped holes 187 which are centered at the corresponding projecting portions 74 are formed so as to penetrate through the body frame 62 in positions which lie in front of the corresponding process guide grooves 71 and spaced apart obliquely upwards and forwards from the corresponding projecting portions 74.

(2) Right-Hand Body Frame

On the right-hand body frame 63, as shown in FIG. 4, four guide grooves 78 are formed respectively in positions which confront the four process guide grooves 71 formed in the left-hand body frame 62 in the transverse direction. The guide grooves 78 are formed by cutting partially the body frame 63 from an upper end thereof, extend obliquely downwards and rearwards from the upper end to a vertically central portion of the body frame 63 and are made to become narrower as they extend downwards.

In addition, on the body frame 63, cylindrical projecting portions 79 which project rightwards are provided respectively in positions which lie space apart forwards and obliquely downwards relative to lower end portions of the corresponding guide grooves 78.

Further, on the body frame 63, guide holes 80 which penetrate through the body frame 63 are formed respectively in positions which lie spaced apart forwards and slightly obliquely downwards relative the corresponding projecting portions 79. Each guide hole 80 has a straight hole portion 81 which extends in the longitudinal direction and an intersecting portion 82 (refer to FIG. 18) which extends obliquely downwards and rearwards from a rear end of the straight hole portion 81.

The frontmost guide hole 80 has a detection hole 83 which extends upwards from a front end of the straight hole portion 81. In addition, the straight hole portion 81 of the frontmost guide hole 80 is formed longer than the straight hole portions 81 of the other guide holes 80.

4. Configuration for Transmitting Driving Force to Process Cartridge

Figure 6:
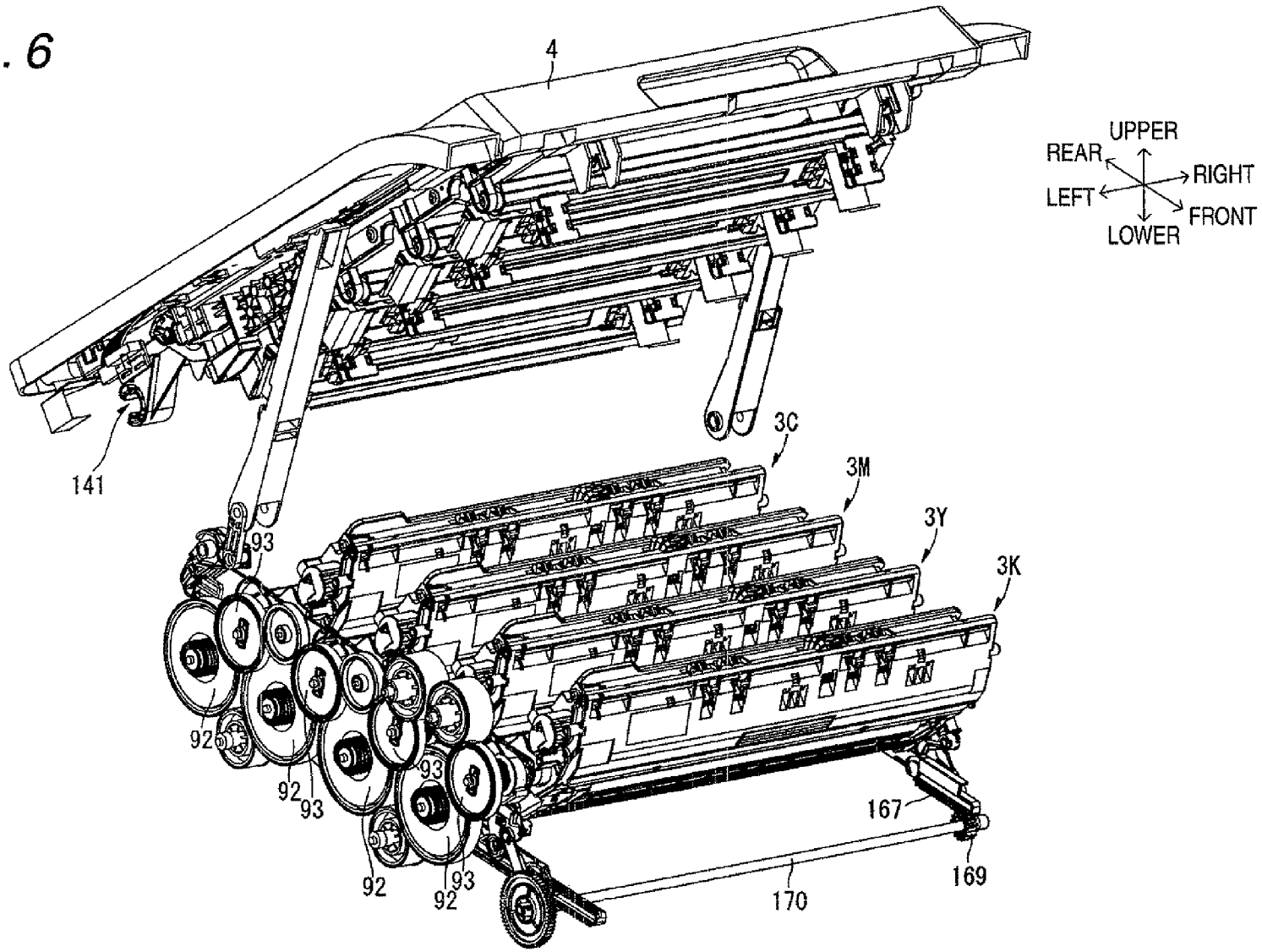
FIG. 6 is a perspective view of a driving force transmission mechanism and a first cover link mechanism as viewed from a left front side thereof.
Figure 7:
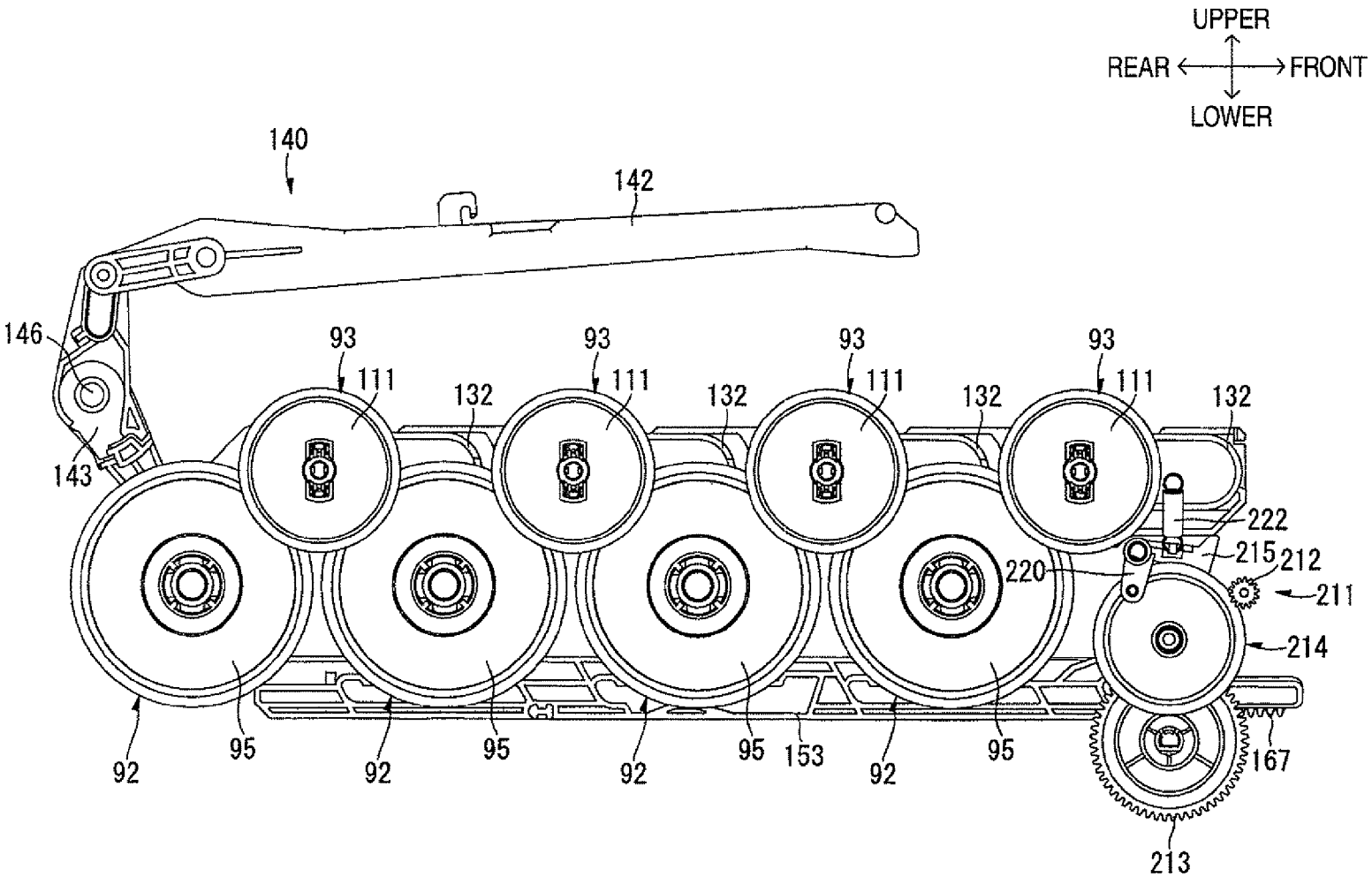
FIG. 7 is a left side view of the driving force transmission mechanism and the first cover link mechanism, showing a state in which a top cover is closed.
Figure 8:
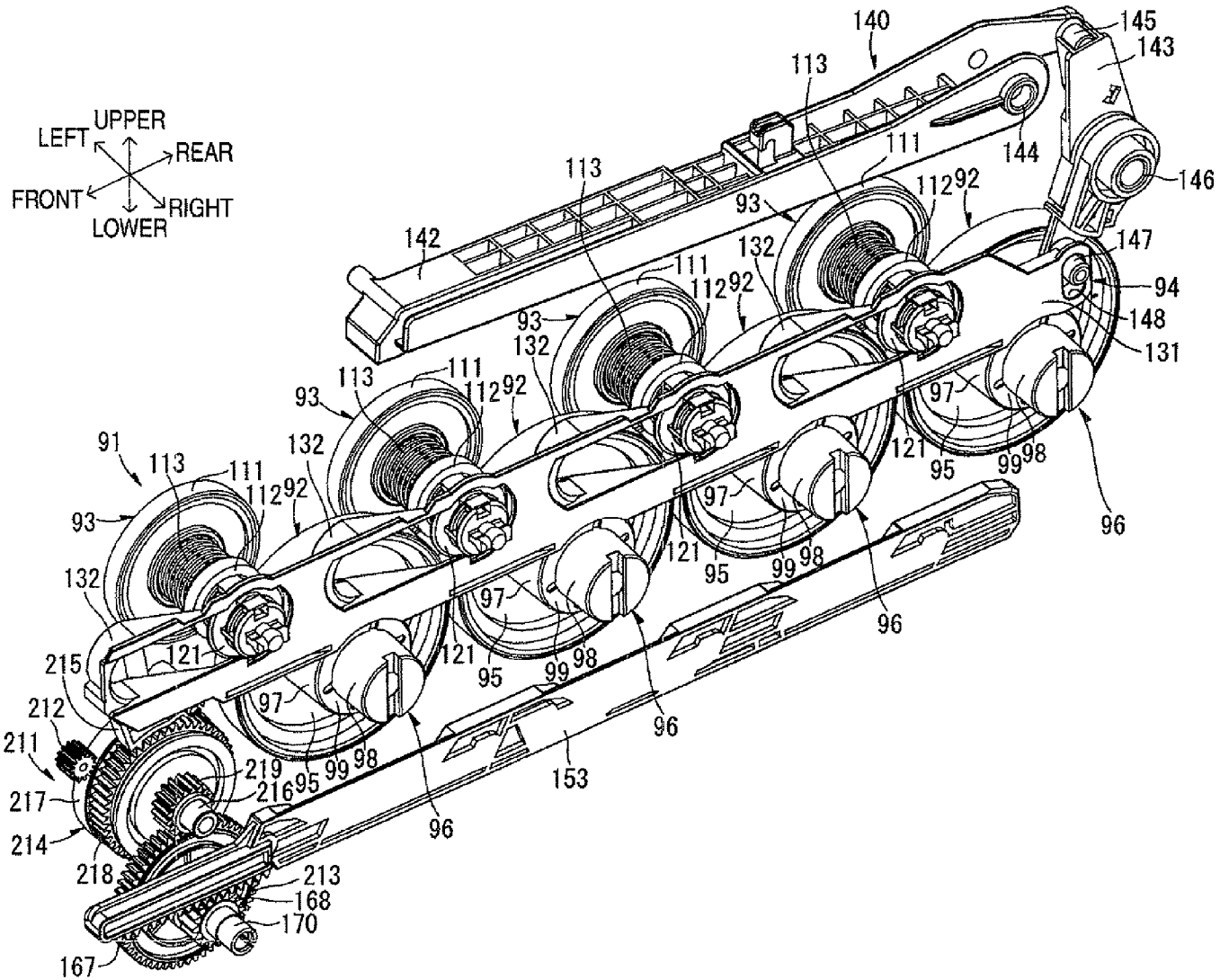
FIG. 8 is a perspective view of the driving force transmission mechanism and the first cover link mechanism as viewed from a right front side thereof, showing the state in which the top cover is closed.
Figure 9:
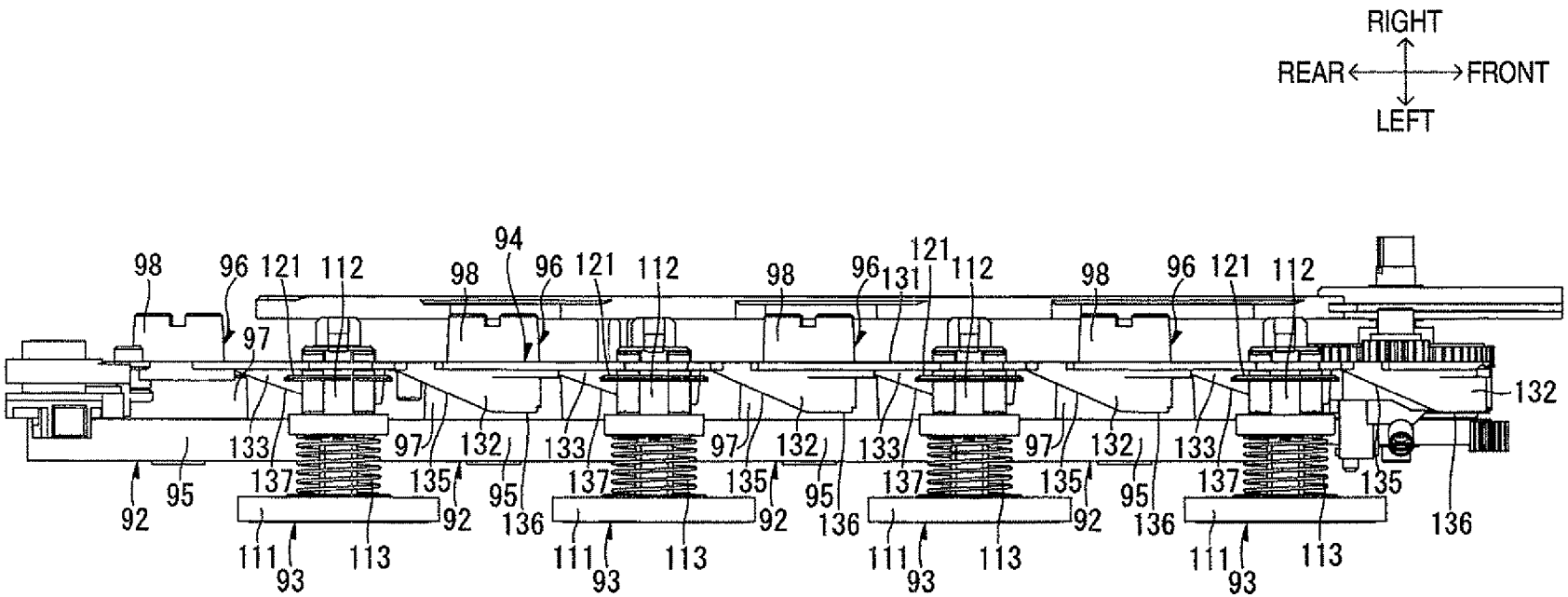
FIG. 9 is a plan view of the driving force transmission mechanism, showing the state in which the top cover is closed.
Figure 10:
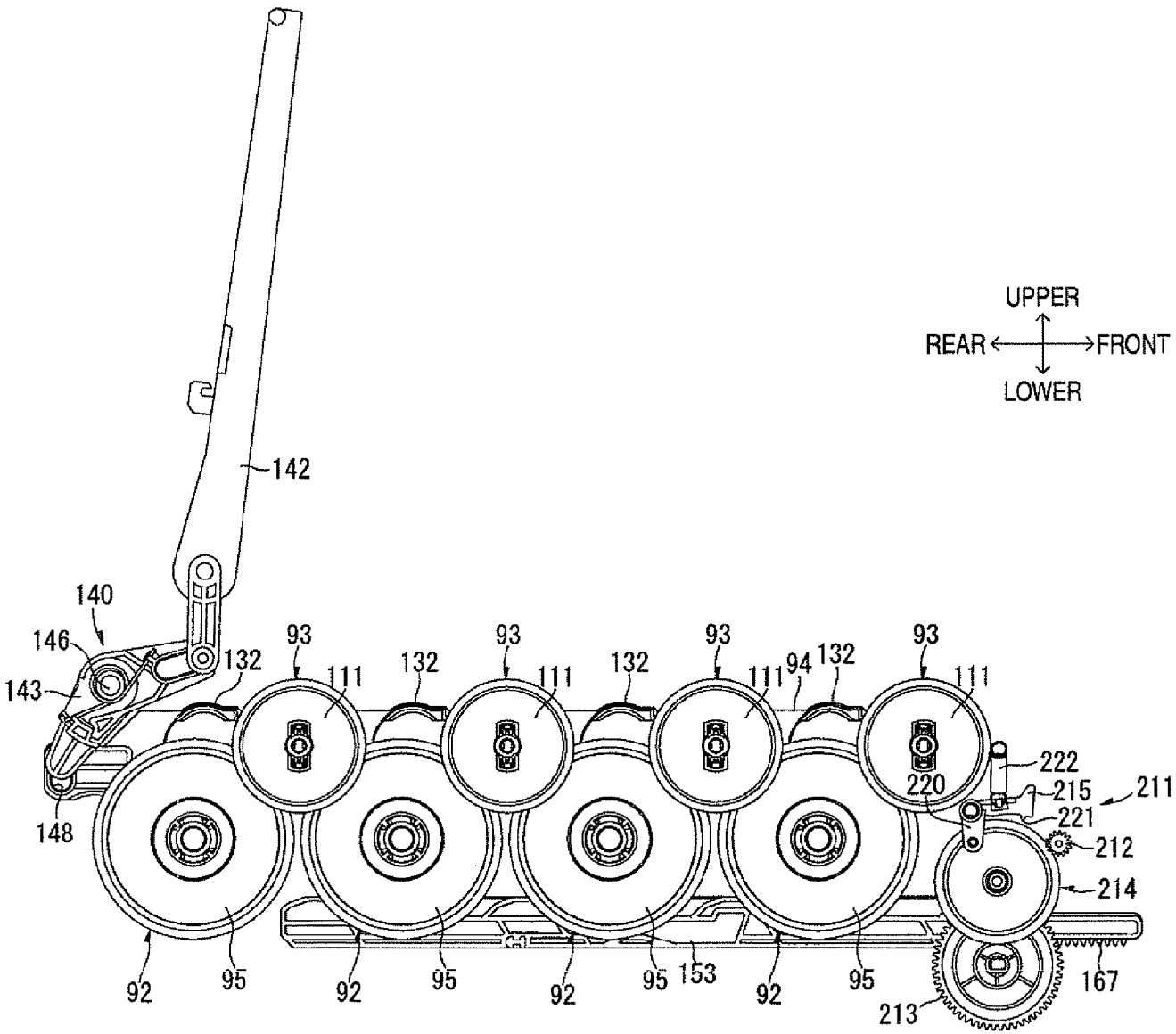
FIG. 10 is a left side view of the driving force transmission mechanism and the first cover link mechanism, showing a state in which the top cover is opened.
Figure 11:
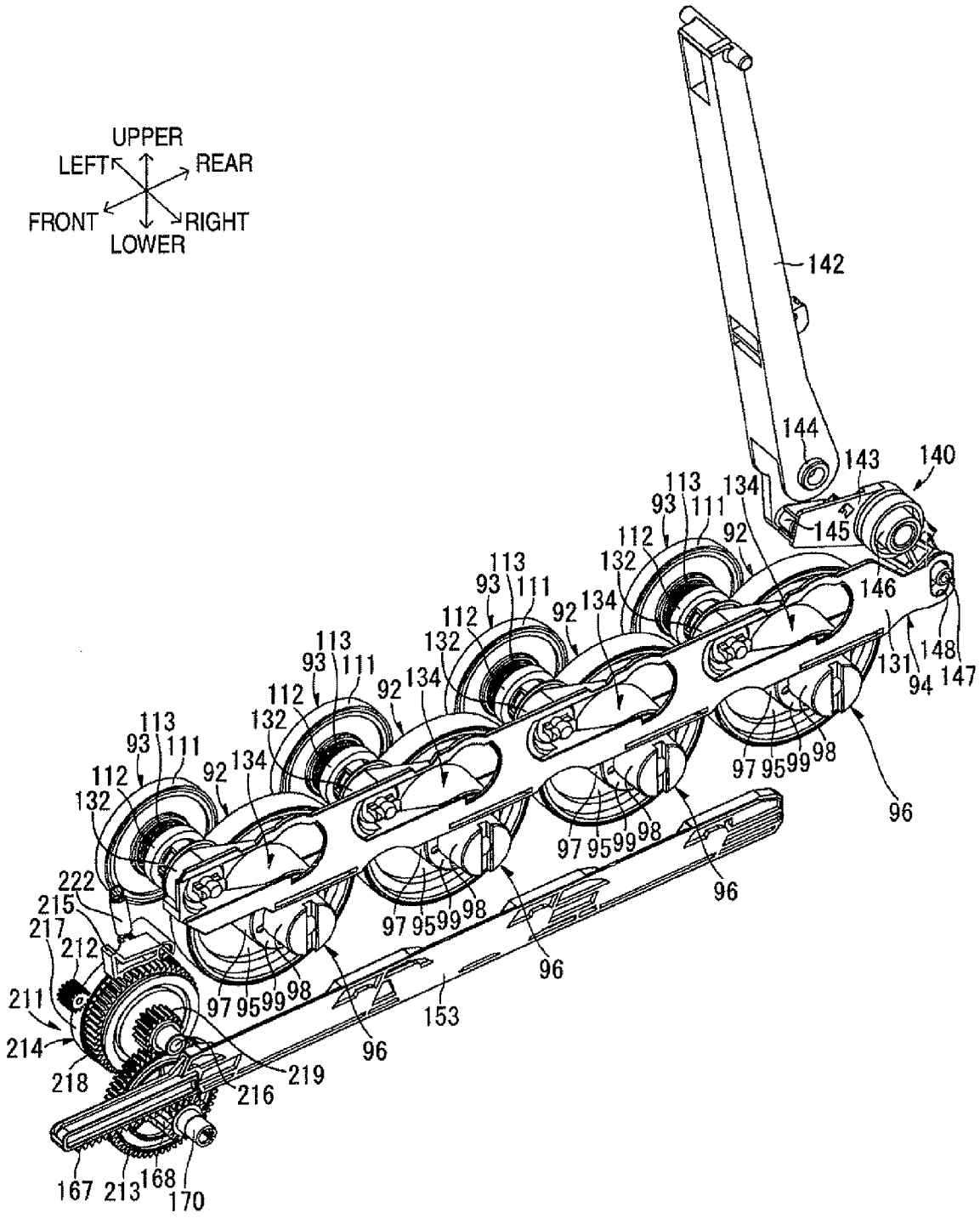
FIG. 11 is a perspective view of the driving force transmission mechanism and the first cover link mechanism as viewed from the right front side thereof, showing the state in which the top cover is opened.
Figure 12:
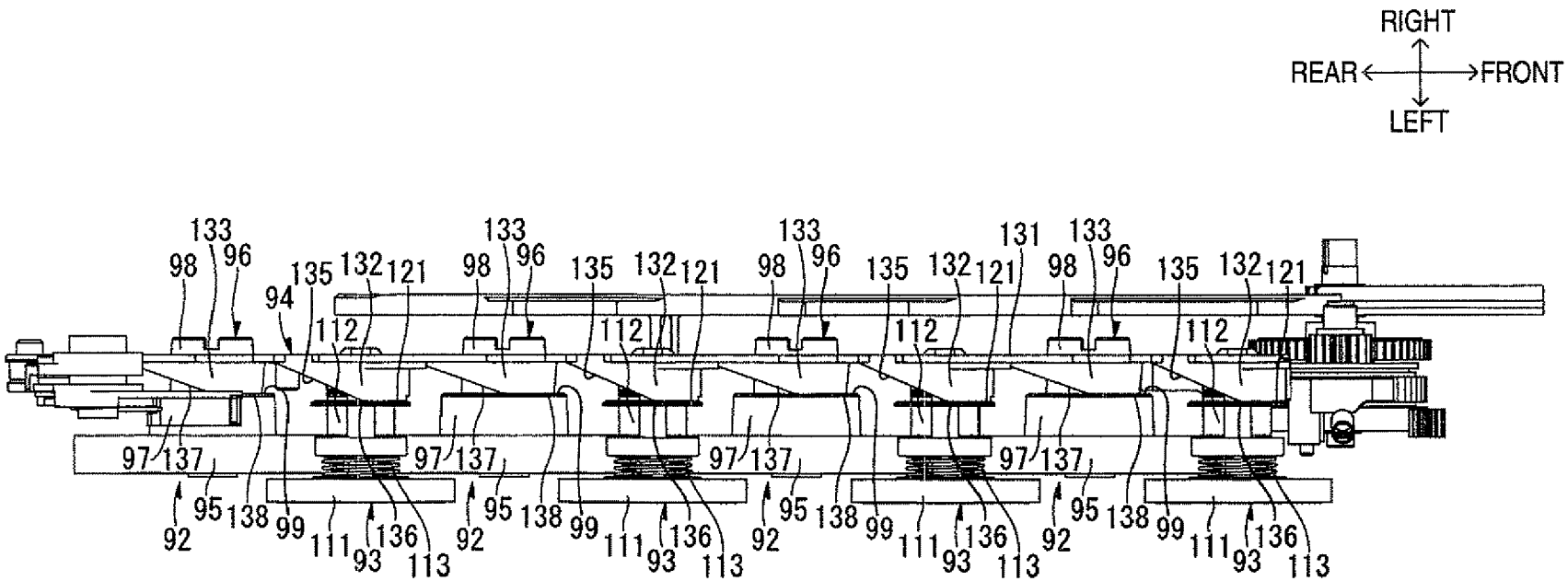
FIG. 12 is a plan view of the driving force transmission mechanism, showing the state in which the top cover is opened.
Figure 13:
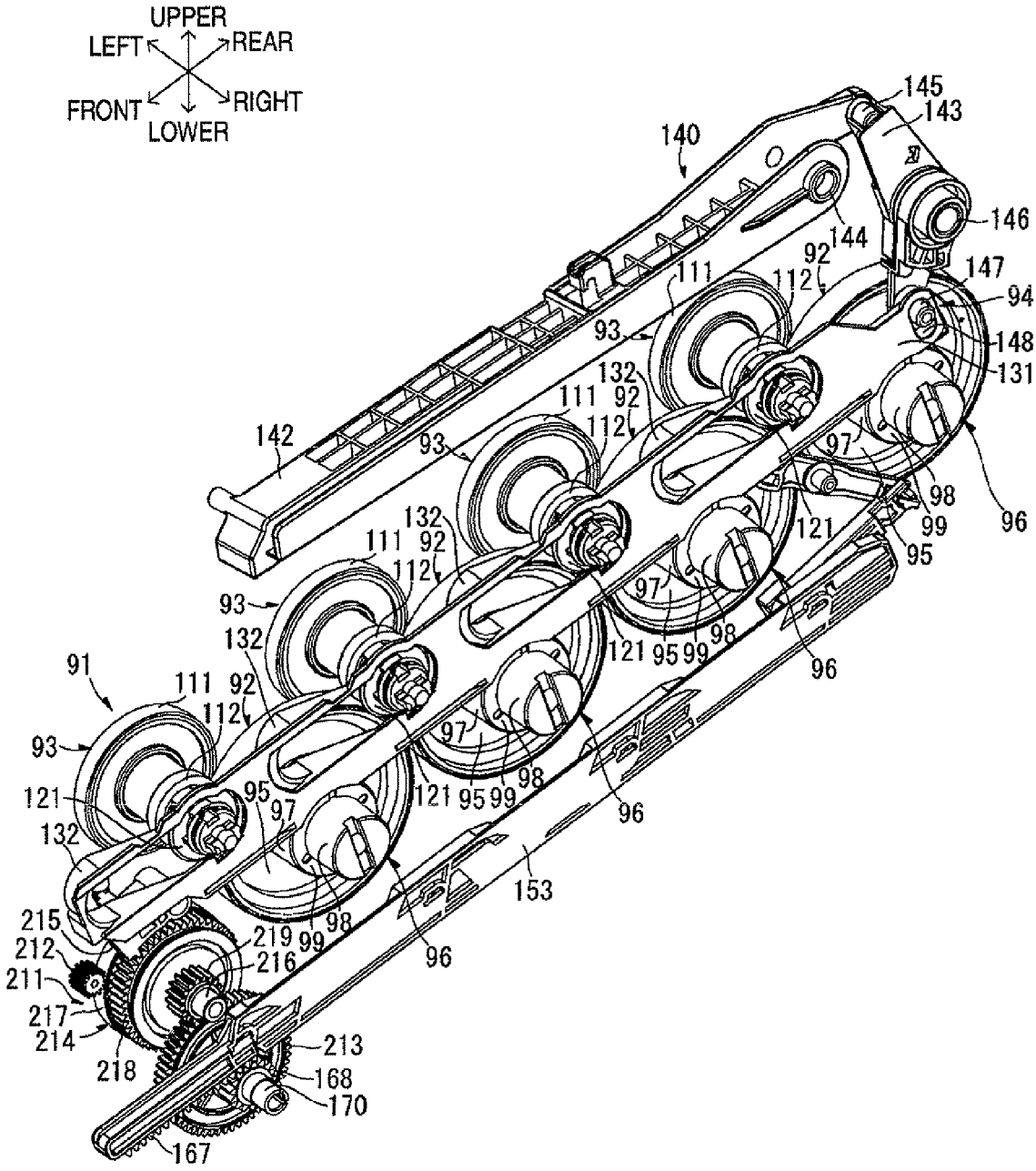
FIG. 13 is a perspective view of the driving force transmission mechanism and the first cover link mechanism as viewed from the right front side thereof, showing the state in which the top cover is once opened and is then closed.

FIG. 6 is a perspective view of a driving force transmission mechanism and a first cover link mechanism as viewed from a left front side thereof. FIG. 7 is a left side view of the driving force transmission mechanism and the first cover link mechanism, showing a state in which the top cover is closed. FIG. 8 is a perspective view of the driving force transmission mechanism and the first cover link mechanism as viewed from a right front side thereof, showing the state in which the top cover is closed. FIG. 9 is a plan view of the driving force transmission mechanism, showing the state in which the top cover is closed. FIG. 10 is a left side view of the driving force transmission mechanism and the first cover link mechanism, showing a state in which the top cover is opened. FIG. 11 is a perspective view of the driving force transmission mechanism and the first cover link mechanism as viewed from the right front side thereof, showing the state in which the cover is opened. FIG. 12 is a plan view of the driving force transmission mechanism, showing the state in which the top cover is opened. FIG. 13 is a perspective view of the driving force transmission mechanism and the first cover link mechanism as viewed from the right front side thereof, showing the state in which the top cover is once opened and is then closed.

In addition, each of FIGS. 6 to 13 shows a fixing/contact and spacing translation cam 153, which is an example of a reciprocating member and a contact and spacing drive mechanism 211. In addition, in FIG. 6, the process cartridges 3 and the top cover 4 are shown.

(1) Driving Force Transmission Member

A driving force transmission mechanism 91 for transmitting a driving force to the process cartridges 3 is provided on an outer side of the left-hand body frame 62. In addition, in FIG. 6, although the body frame 62 is disposed between the four process cartridges 3 and the driving force transmission mechanism 91, the body frame 62 is omitted from the figure for the sake of simple depiction.

As shown in FIGS. 8, 11 and 13, the driving force transmission mechanism 91 includes four drum drive transmission members 92, four developing drive transmission members 93 and a driving translation cam 94.

(1-1) Drum Drive Transmission Members

The four drum drive transmission members 92 are provided so as to correspond respectively to the process cartridges 3. The drum drive transmission members 92 are disposed in positions where they confront the flange members 46 provided on the corresponding process cartridges 3 when the corresponding process cartridges 3 come into a state in which they are brought into abutment with preventing members 191, which will be described later, (a state in which attachment is disrupted).

The drum drive transmission member 92 includes integrally a substantially disk-shaped gear portion 95 and a projecting portion 96 which projects rightwards from a central portion of the gear portion 95.

A number of gear teeth into which a driving force from a drum motor is inputted are formed on an outer circumferential surface of the gear portion 95.

The projecting portion 96 has a cylindrical proximal outer circumferential surface 97, a cylindrical distal outer circumferential surface 98 which is formed next to a right-hand side of the proximal outer circumferential surface 97 and which has a smaller diameter than the proximal outer circumferential surface 97 and a ring-shaped erected surface 99 constituting a difference in level between the proximal outer circumferential surface 97 and the distal outer circumferential surface 98 which is connected to a distal end of the proximal outer circumferential surface 97 and a proximal end of the distal outer circumferential surface 98.

In addition, a holder is attached to an outer surface (a left side surface) of the left-hand body frame 62 so as to cover the driving force transmission mechanism 91. On the holder, support shafts are provided so as to correspond respectively to the drum drive transmission members 92, and the support shafts project so as to extend rightwards. The drive transmission members 92 are supported on the support shafts so as to rotate and to advance and retreat in a right-left or transverse direction. Coil springs are interposed respectively between the drum drive transmission members 92 and the holder.

(1-2) Developing Drive Transmission Members

As shown in FIG. 6, the four developing drive transmission members 93 are provided so as to correspond respectively to the process cartridges 3. The developing drive transmission members 93 are disposed in positions where they confront the developing passive gears 61 (refer to FIG. 3) provided on the corresponding process cartridges 3 (the developing cartridges 9) when the corresponding process cartridges 3 come into a state in which they are brought into abutment with the preventing members 191, which will be described later, (a state in which attachment is disrupted).

As shown in FIGS. 8, 9, 11 and 12, the developing drive transmission member 93 includes a substantially disk-shaped developing drive gear 111, an advance and retreat member which is provided so as to advance and retreat in the transverse direction relative to the developing drive gear 111 and a coil spring 113 which is interposed between the developing drive gear 111 and the advance and retreat member 112.

A number gear teeth into which a driving force of a developing motor is inputted are formed on an outer circumferential surface of the developing drive gear 111.

The advance and retreat member 112 has at its transverse intermediate portion a collar portion 121 which projects along the full circumference thereof.

In addition, on the holder attached to the outer surface of the body frame 62, support shafts are provided so as to correspond respectively to the developing drive transmission members 93, and the support shafts project so as to extend rightwards.

(1-3) Driving Translation Cam

As shown in FIGS. 8, 9, 11, 12 and 13, the driving translation cam 94 is a member which extends long in a front-back or longitudinal direction and is attached to the body frame 62 (refer to FIG. 4) so as to reciprocate in straight line in the longitudinal direction. As shown in FIGS. 9 and 12, the driving translation cam 94 includes a longitudinally elongated rectangular plate-shaped body portion 131, four first cam portions 132 which are formed integrally on the body portion 131, and four second cam portions 133 which are formed integrally on the body portion 131.

The body portion 131 is provided in parallel with the body frame 62. Four insertion and withdrawal holes 134 are formed in the body portion 131. The insertion and withdrawal holes 134 are formed in positions which confront, respectively, to the four developing drive transmission members 93 in the transverse direction. Each insertion and withdrawal hole 134 is formed into a longitudinally elongated hole and has dimensions which permit vertical insertion and withdrawal of the advance and retreat member 112 of the corresponding developing drive transmission member 93. As shown in FIG. 8, in such a state that the driving translation cam 94 is disposed in a relatively forward position, the developing drive transmission members 93 confront rear end portions of the corresponding insertion and withdrawal holes 134. On the other hand, as shown in FIG. 11, in such a state that the driving translation cam 94 is disposed in a relatively rearward position, the developing drive transmission members 93 confront front end portions of the corresponding insertion and withdrawal holes 134.

The first cam portions 132 are provided on a left side surface of the body portion 131 (an opposite surface to a surface confronting the body frame 62) so as to correspond respectively to the insertion and withdrawal holes 134. The first cam portion 132 has a substantially U-shape as viewed from the side which matches substantially a front half circumference of a full circumferential edge of the insertion and withdrawal hole 134. In addition, as shown in FIG. 12, the first cam portion 132 has an inclined portion 135 which is inclined so as to move away from the body portion 131 as it extends forwards and a flat portion which extends in parallel with the body portion 131 from a front end of the inclined portion 135 and has a substantially trapezoidal shape as viewed from the top.

The second cam portions 133 are provided at lower portions of the left side surface of the body portion 131 so as to correspond respectively to the drum drive transmission members 92. As shown in FIGS. 9 and 12, the second cam portion 133 is formed at the rear of the corresponding first cam portion 132 so as not to overlap the first cam portion 132 as viewed from the top. As shown in FIG. 12, the second cam portion 133 has an inclined portion 137 which is inclined so as to move away from the body portion 131 as it extends forwards and a flat portion 138 which extends in parallel with the body portion 131 from a front end of the inclined portion 137 and has a substantially trapezoidal shape as viewed from the top.

In states shown in FIGS. 8, 9 and 13, the advance and retreat member 112 of each developing drive transmission member 93 is inserted into the rear end portion of the insertion and withdrawal hole 134, the collar portion 121 is in abutment with the left side surface of the body portion 131 of the driving translation cam 94, and a distal end portion of the advance and retreat member projects rightwards relative to the body portion 131. In addition, the drum drive transmission member 92 is in such a state that the erected surface 99 is in abutment with the left side surface of the body portion 131 of the driving translation cam 94, and a distal end portion (the portion where the distal outer circumferential surface 98 is formed) of the projecting portion 96 projects rightwards relative to the body portion 131 below the body portion 131. The second cam portions 133 are situated forwards respectively of the corresponding drum drive transmission members 92. Namely, the respective drum drive transmission members 92 and the advance and retreat members 112 of the respective developing drive transmission members 93 both have advanced to an advance position.

When the driving translation cam 94 is shifted towards the rear from this state, the inclined portions 135 of the respective first cam portions 132 are brought into abutment with the collar portions 121 of the corresponding advance and retreat members 112, and the inclined portions 137 of the second cam portions 133 are brought into the erected surfaces 99 of the corresponding drum drive transmission members 92. When the driving translation cam 94 is shifted to the rear further, the advance and retreat members 112 and the first cam portions 132 move relatively such that the collar portions 121 of the respective advance and retreat members 112 ride on the inclined portions 135 of the corresponding first cam portions 132. In conjunction with this action, the respective advance and retreat members 112 receive a leftward force from the corresponding first cam portions 132 and are shifted leftwards against the pressing force of the corresponding coil springs 113. In addition, the drum drive transmission members 92 and the second cam portions 133 move relatively such that the erected surfaces 99 of the respective drum drive transmission members 92 ride on the inclined portions 137 of the corresponding second cam portions 133. In conjunction with this action, the respective drum drive transmission members 92 receive a leftward force from the corresponding second cam portions 133 and are shifted leftwards against the corresponding coil springs, not shown.

In addition, in states shown in FIGS. 11 and 12, the respective advance and retreat members 112 are in abutment with the flat portions 136 of the first cam portions 132 at the collar portions 121, and only engagement portions 120 are inserted into the front end portions of the insertion and withdrawal holes 134. In addition, the respective drum drive transmission members 92 are in abutment with the flat portions 138 of the second cam portions 132 at the erected surfaces 99, and the distal end portions of the projecting portions 96 project slightly rightwards relative to the body portion 131. Namely, both the respective drum drive transmission members 92 and the advance and retreat portions 112 of the corresponding developing drive transmission members 93 are both in retreat in their retreat positions.

(2) First Cover Link Mechanism

In addition, in the printer 1, the driving translation cam 94 is made to move in conjunction with the opening and closure of the top cover 4. Namely, the printer 1 includes a first cover link mechanism 140 for shifting the driving translation cam 94 in a linked fashion in conjunction with the opening and closure of the top cover 4.

As shown in FIG. 6, by a shaft being inserted rotatably in substantially C-shaped rotation support portions 141 which are provided at a rear end portion of the top cover 4, the top cover 4 is rotated so as to move between a state where a front end portion thereof is raised from the body casing 2 (refer to FIG. 1) so as to open an upper surface of the body casing 2 and a state where the top cover 4 extends along the upper surface of the body casing 2 so as to close the upper surface of the body casing 2.

As shown in FIG. 7, the first cover link mechanism 140 includes first cover link members 142 and second cover link members 143. The first cover link members 142 and the second cover link members 143 are provided so as to be associated with the left- and right-hand body frames 62, 63 (refer to FIG. 4). The first cover link member 142 and the second cover link member 143 which are provided in association with the left-hand body frame 62 and the first link member 142 and the second link member 143 which are provided in association with the right-hand body frame 63 have a transversely symmetrical configuration, and hence, hereinafter, the first cover link member 142 and the second cover link member 143 will be taken for description of the first cover link mechanism.

As shown in FIG. 8, the first link cover member 142 has a straight-line long shape. One end portion of the first cover link member 142 is connected to a longitudinally intermediate portion of a left end portion of an inner surface of the top cover 4 so as to rotate round an axis extending along the transverse direction. The first cover link member 142 extends in the longitudinal direction along the inner surface of the top cover 4 in such a state that the top cover 4 is closed. The other end portion of the first cover link member 142 is connected to the rear end portion of the body frame 62 so as to rotate round an axis extending in the transverse direction. In addition, a connecting shaft 145 is formed at a rearmost end portion of the first cover link member 142 so as to project rightwards.

The second cover link member 143 has a V-shape as viewed from the side which is opened at a relatively large angle (for example, about 135°). A support shaft 146 is formed at a bent portion of the second cover link member 143 so as to project rightwards. By the support shaft 146 being supported rotatably at the rear end portion of the body frame, the second cover link member 143 is provided so as to rotate about the support shaft 146. The connecting shaft 145 of the first cover link member 142 is inserted rotatably in one end portion of the second cover link member 143. A connecting shaft 147 is formed at the other end portion of the second cover link member 143 so as to project rightwards. A vertically elongated long hole 148 is formed at a rear end portion of the body portion 131 of the driving translation cam 94, and the connecting shaft 147 is inserted loosely in this long hole 148 so as not only to rotate but also to move vertically.

When the top cover 4 is opened from the state in which the top cover 4 is closed (the state shown in FIG. 8), the first cover link member 142 rotates about the other end portion 144 thereof so as to be erected. In conjunction with the rotation of the first cover link member 142, the one end portion of the second cover link member 143 is pushed forwards by the support shaft 146 of the second cover link member 143. Then, the other end portion of the second cover link member 143 moves rearwards, whereby the driving translation cam 94 is pushed rearwards by the connecting shaft 147, and the driving translation cam 94 moves rearwards. Then, when the top cover 4 is completely opened, the driving translation cam 94 is disposed in its rearmost position.

When the top cover is closed from the opened state, the first cover link member 142 rotates about the other end portion 144 thereof so as to fall down. The one end portion of the second cover link member 143 is pushed rearwards by the connecting shaft 145 in conjunction with the rotation of the first cover link member 142. Then, the second cover link member 143 rotates about the support shaft 146 and the other end portion of the second cover link member 143 moves forwards. Then, the driving translation cam 94 is pushed forwards by the connecting shaft 147 as a result of the other end portion of the second cover link member 143 moving forwards, whereby the driving translation cam 94 moves forwards. Then, when the top cover 4 is closed completely, the driving translation cam 94 is disposed in a position shown in FIG. 13 (the same position as the position shown in FIG. 8).

5. Locking Mechanism

Figure 14:
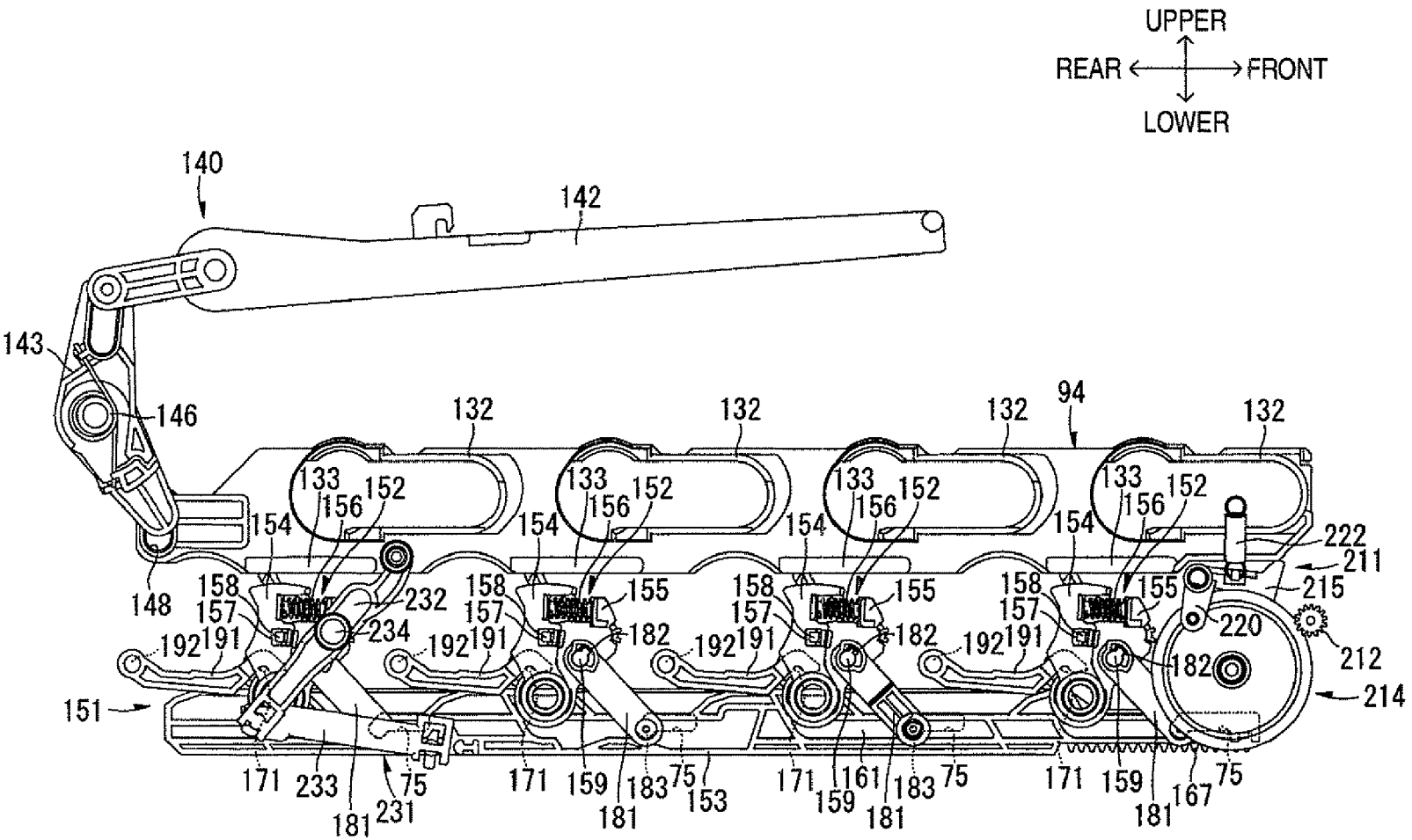
FIG. 14 is a left side view of a locking mechanism, showing a state in which the top cover is closed.
Figure 15:
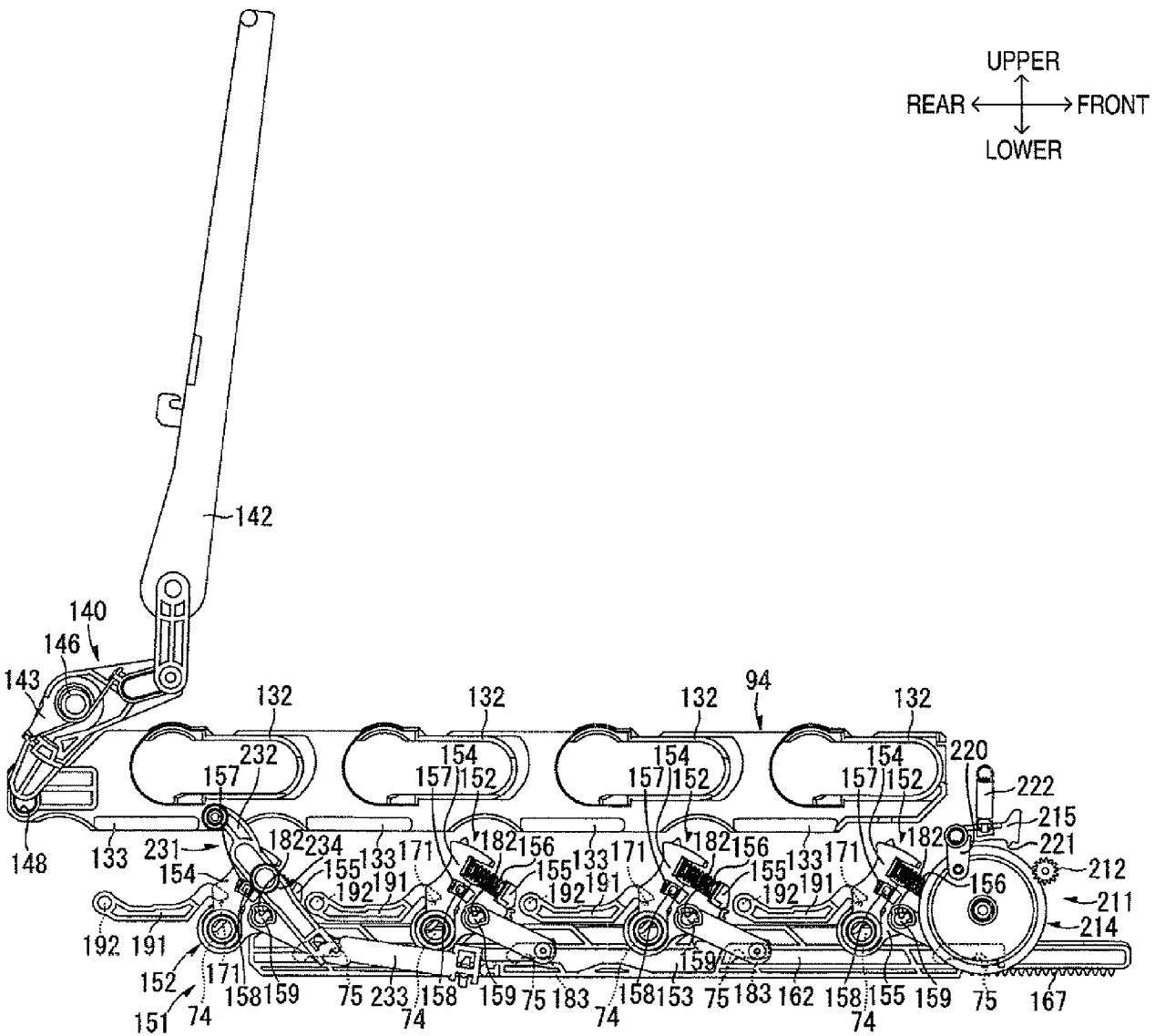
FIG. 15 is a left side view of the locking mechanism, showing a state in which the top cover is opened.
Figure 16:
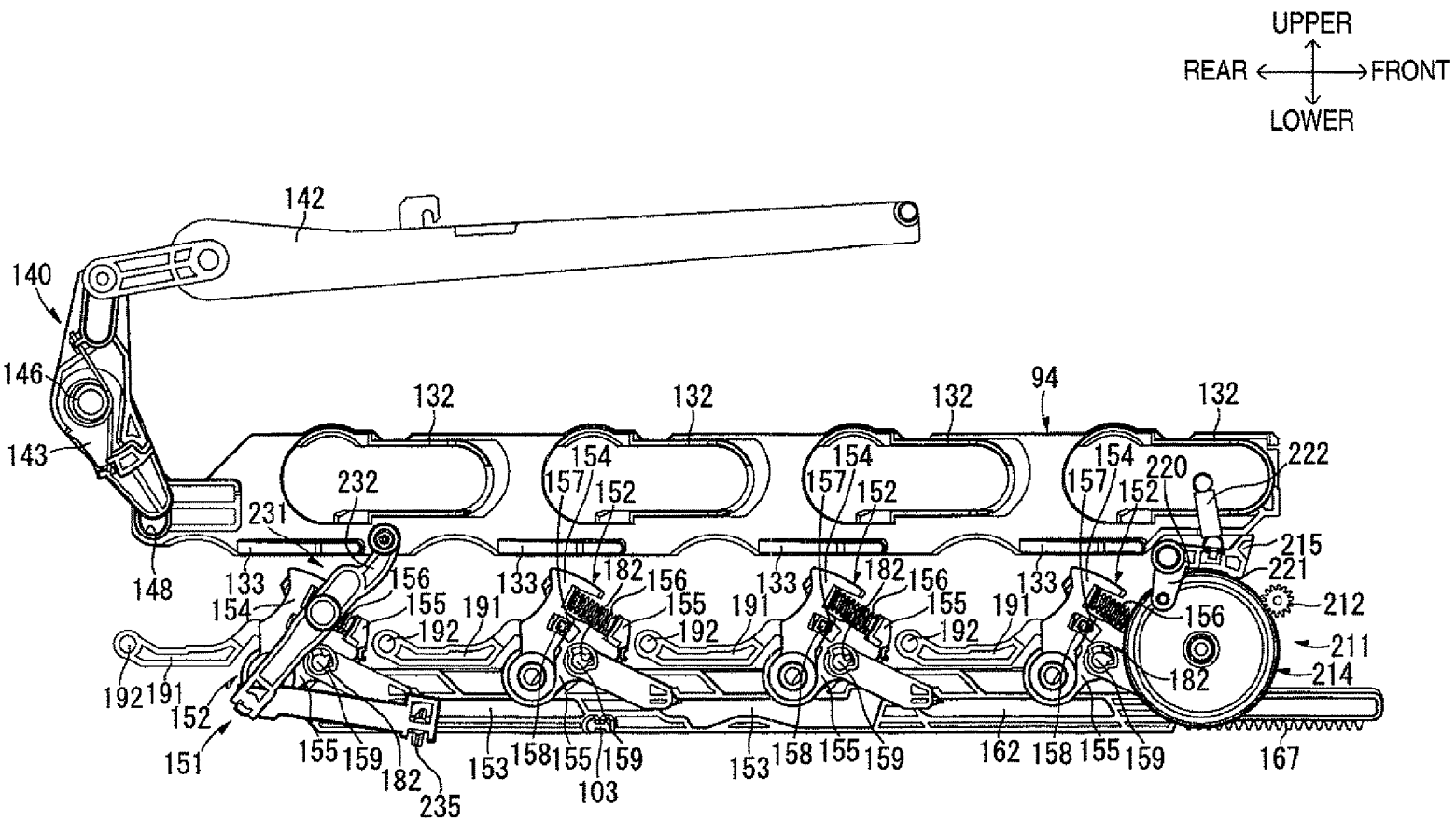
FIG. 16 is a left side view of the locking mechanism, showing a state in which the top cover is closed after it has once been opened.

FIG. 14 is a left side view of a locking mechanism, showing a state in which the top cover is closed. FIG. 15 is a left side view of the locking mechanism, showing a state in which the top cover is opened. FIG. 16 is a left side view of the locking mechanism, showing a state in which the top cover is closed after it has once been opened.

Shown in FIGS. 14, 15 and 16 are the driving translation cam 94, the first cover link mechanism 140, preventing members 191, which will be described later, the contact and spacing drive mechanism 211, and a second cover link mechanism 231.

A locking mechanism 151 is provided on the printer 1 for fixing the respective process cartridges 3 to the body frames 62, 63 (refer to FIG. 4).

The locking mechanism 151 includes four left-hand fixing members 152, which is an example of displacement members which are fixing members, four right-hand fixing members 172 (refer to FIG. 17), which is an example of displacement members which are fixing members, and a pair of left and right fixing/contact and spacing translation cams 153.

(1) Left-Hand Fixing Members

The four left-hand fixing members 152 are disposed on a left-hand side of the left-hand body frame 62. In addition, the four left-hand fixing members 152 are provided so as to correspond, respectively, to the process cartridges 3 and are disposed in front of the protecting portions 30 (refer to FIG. 3), respectively, in such a state that the four process cartridges 3 are attached within the body casing 2. Each left-hand fixing member 152 includes a lock lever 154, a pressing lever 155 and a coil spring 156.

The lock lever 154 is supported rotatably on the projecting portion 74 (refer to FIG. 5) which is formed on the left-hand body frame 62 at one end portion (a proximal end portion) thereof. A substantially rectangular hole 157 is formed at a central portion of the lock lever 154 so as to penetrate therethrough. A front end of the other end portion (a distal end portion) of the lock lever 154 has a curved shape which corresponds to an external shape of the protecting portion 30 of the process cartridge 3. An operating portion 171 is formed on a right side surface of the lock lever 154 in a position which lies closer to the distal end portion than the hold 157 so as to project rightwards.

The pressing lever 155 is disposed at a front side and on a right-hand side of the lock lever 154 and is supported rotatably on the projecting portion 74 (refer to FIG. 5) at one end portion (a proximal end portion) thereof. A hook portion 158 is formed at a central portion of the pressing lever 155, and the hook portion 158 projects forwards and is bent leftwards at a distal end portion thereof. The distal end portion of the hook portion 158 is inserted into the hole 157 in the lock lever 154 from the right. In addition, a connecting shaft 159 is formed at the central portion of the pressing lever 155 so as to project leftwards from a left side surface thereof. Furthermore, a support portion 160 (refer to FIG. 20) is formed at the central portion of the pressing lever 155 for supporting a spacing member 201, which will be described later. The support portion 160 projects rightwards from a right side surface of the pressing lever 155, passes through the hole 187 (refer to FIG. 5) in the body frame 62 and is situated on a right side surface of the body frame 62 at a distal end thereof.

The coil spring 156 is interposed between the distal end portion of the lock lever 154 and the distal end portion of the pressing lever 155.

(2) Right-Hand Fixing Members

Figure 17:
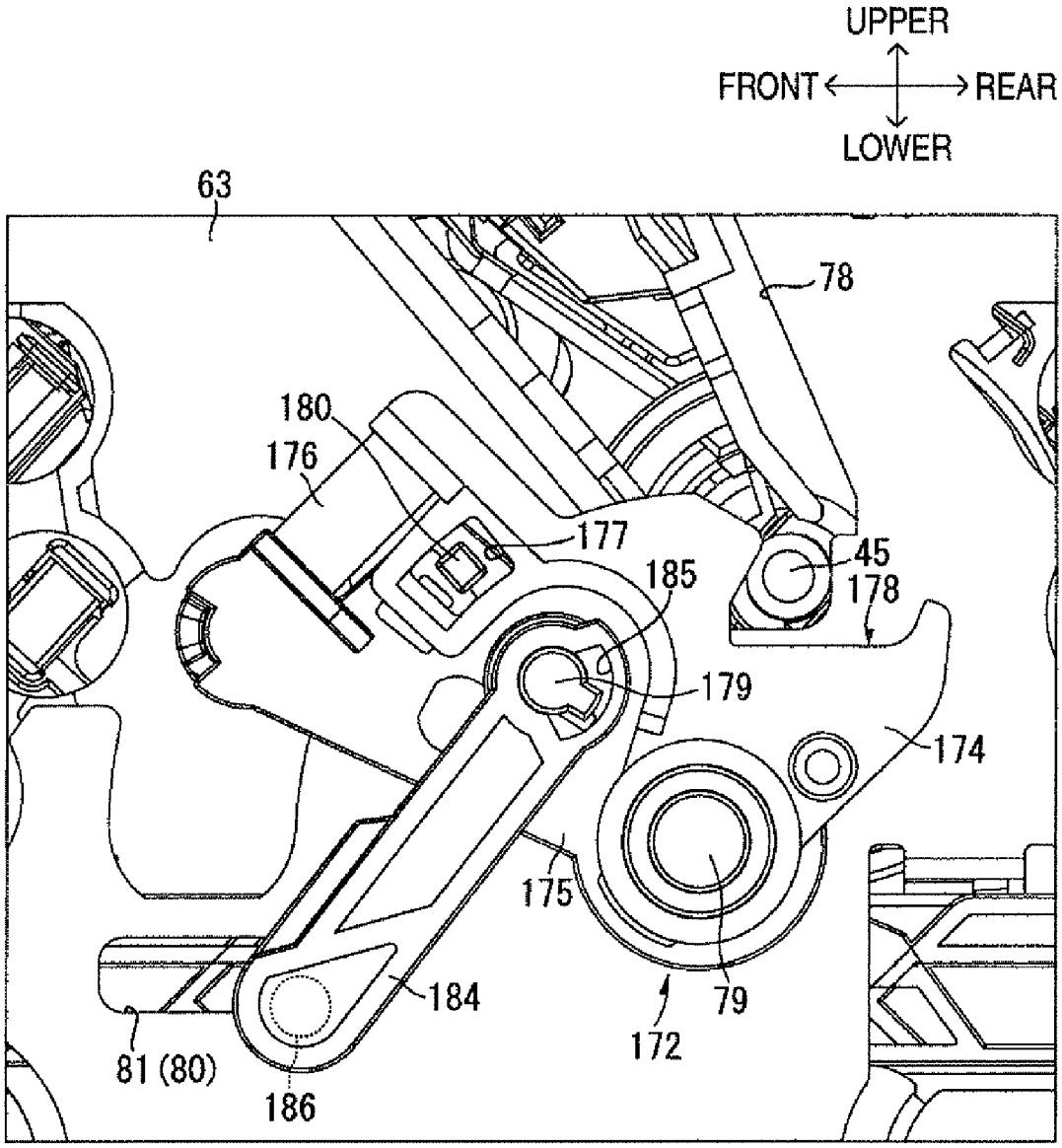
FIG. 17 is a right side view of part of the right-hand side body frame, showing a state in which the top cover is closed.
Figure 18:
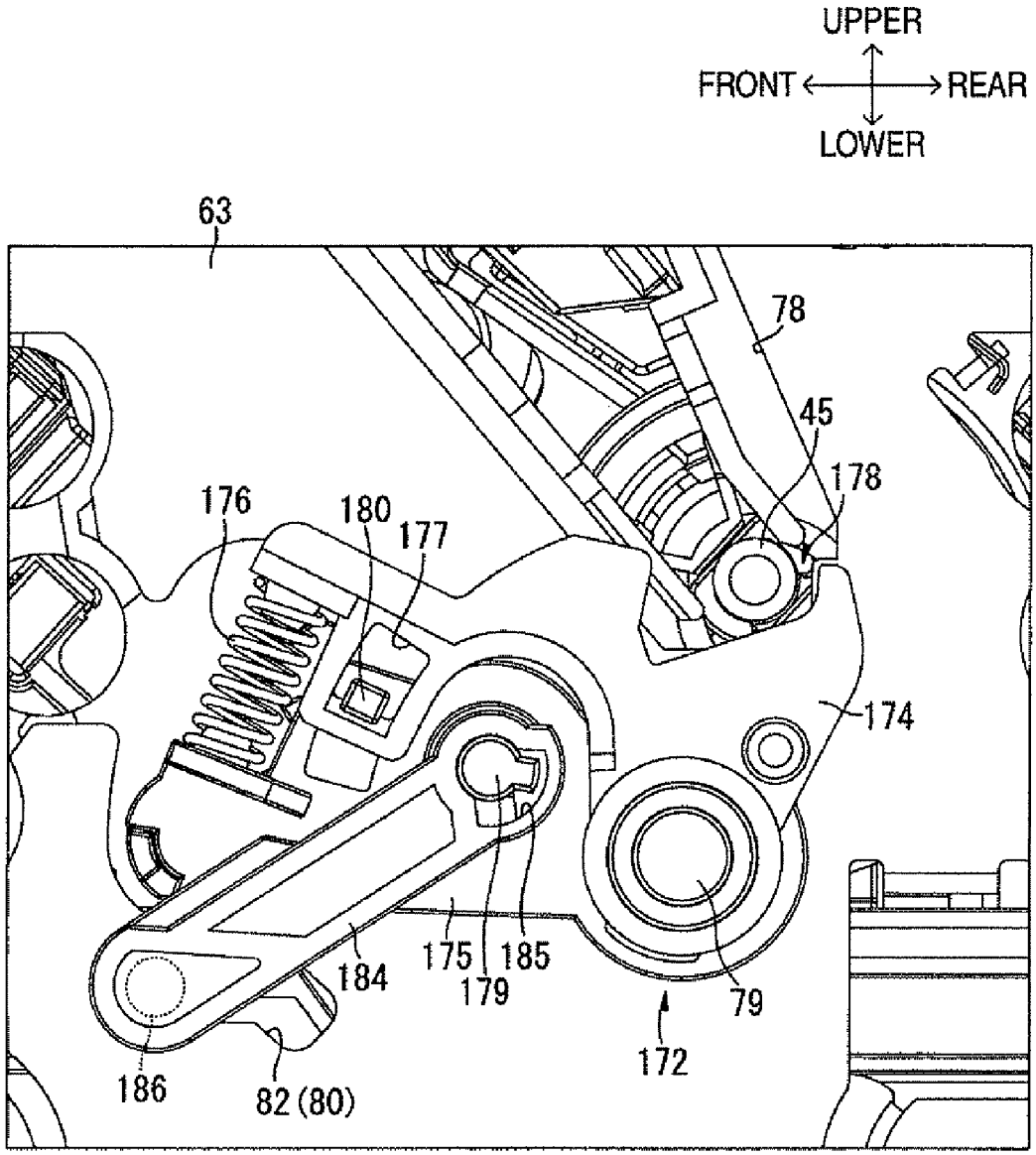
FIG. 18 is a right side view of the part of the right-hand body frame, showing a state in which the top cover is opened.

FIG. 17 is a right side view of part of the right-hand side body frame, showing a state in which the top cover is closed. FIG. 18 is a right side view of the part of the right-hand body frame, showing a state in which the top cover is opened.

The four right-hand fixing members 172 are provided so as to correspond respectively to the process cartridges 3 and are disposed on a right side surface of the right-hand body frame 63. The right-hand fixing members 172 each include a lock lever 174, a pressing lever 175 and a coil spring 176.

The lock lever 174 has a substantially C-shape as viewed from the side. The lock lever 174 is supported rotatably on the projecting portion 79 which is formed on the right-hand body frame 63 at one end portion (a proximal end portion) thereof. A substantially rectangular hole 177 is formed at the other end portion (a distal end portion) of the lock lever 174 so as to penetrate therethrough. In addition, in the lock lever 174, a recessed cut-out portion 178 is formed between the proximal end portion and the distal end portion, and the cut-out portion 178 is cut out so as to be recessed downwards.

The pressing lever 175 is disposed at a front side and on a left-hand side of the lock lever 174 and is supported rotatably on the projecting portion 79 at one end portion (a proximal end portion) thereof. A locking portion 180 is formed at a distal end portion of the pressing lever 175 so as to project rightwards. A distal end portion of the locking portion 180 is inserted in the hole 177 in the lock lever 174 from the left. In addition, a connecting shaft 179 is formed at a central portion of the pressing lever 175 so as to project rightwards. Furthermore, a support portion is formed at the central portion of the pressing lever 175 so as to project rightwards from a right side surface of the pressing lever 175, and the spacing member 201, which will be described later, is supported rotatably on this support portion.

The coil spring 176 is interposed between the distal end portion of the lock lever 174 and the distal end portion of the pressing lever 175.

(3) Fixing/Contact and Spacing Translation Cams

Figure 19:
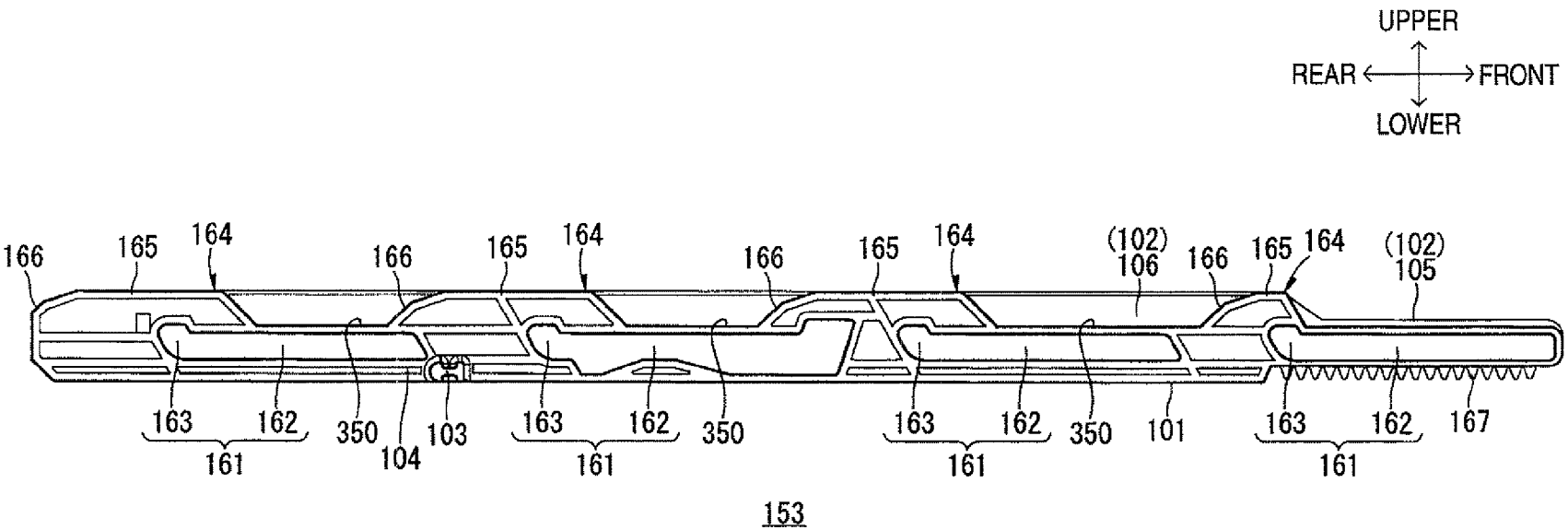
FIG. 19 is a left side view of the fixing/contact and spacing translation cam.

FIG. 19 is a left side view of the fixing/contact and spacing translation cam.

Since the left-hand and right-hand fixing/contact and spacing translation cams 153 have a transversely symmetrical configuration, hereinafter, the left-hand fixing/contact and spacing translation cam 153 will be taken for description of the configuration of the fixing/contact and spacing translation cams.

The fixing/contact and spacing translation cam 153 is attached to an inner surface of the body frame 62 (refer to FIG. 4) so as to reciprocate in a straight line in the longitudinal direction. The fixing/contact and spacing translation cam 153 includes integrally a cam body 101 which extends in the longitudinal direction and a cam side plate 102 having a longitudinally extending thin plate shape which is formed on a right-hand side of the cam body 101.

Four guide grooves 161 are formed on a left side surface of the cam body 101 so as to correspond respectively to the left-hand fixing members 152. The guide grooves 161 each have a straight groove portion 162 which extends long in the longitudinal direction and an intersecting groove portion 163 which extends short obliquely upwards and rearwards from a rear end of the straight groove portion 162.

In addition, a projecting portion 103 projecting leftwards is formed integrally on the left side surface of the cam body 101 in a position lying obliquely downwards and forwards relative to a front end portion of the straight groove portion 162 of the rearmost guide groove 161.

Further, a longitudinally extending slider guide groove 104 is formed on the left side surface of the cam body 101 in a position lying at the rear of the projecting portion 103 and below the rearmost guide groove 161.

Four third cam portions 164 are formed on an upper surface of the cam body 101 so as to be spaced apart from one another at predetermined intervals in the longitudinal direction. The four cam portions 164 are each formed to have a substantially trapezoidal shape as viewed from the side which projects upwards from the upper surface 350 of the cam body 101 and each have a longitudinally extending horizontal surface 165 and an inclined surface 166 which continuously connects to a rear end of the horizontal surface 165 and the upper surface 350 of the cam body 101. A space between the frontmost third cam portion 164 and the third cam portion 164 which lies adjacent thereto is made longer than spaces which lie between the other third cam portions 164 which lie adjacent to one another.

A rack gear 167 is formed on a lower surface of a front end portion of the cam body 101. As shown in FIG. 8, a pinion gear 168 is made to mesh with the rack gear 167 on the fixing/contact and spacing translation cam 153. On the other hand, a pinion gear 169 is, as shown in FIG. 6, made to mesh with the rack gear 167 of the right-hand fixing/contact and spacing translation cam 153. The left and right pinion gears are attached to a left end portion and a right end portion of a connecting shaft 170 so as not to rotate on the connecting shaft 170. By this configuration, when the left-hand fixing/contact and spacing translation cam 153 moves in the longitudinal direction, the right-hand fixing/contact and spacing translation cam 153 moves in the same direction by the same moving amount in synchronism with the longitudinal movement of the left-hand fixing/contact and spacing translation cam 153.

The cam side plate 102 includes a front confronting portion 105 which confronts a front end portion of the cam body 101, and a rear confronting portion 106 which confronts a portion which extends from the frontmost third cam portion 164 to the rearmost third cam portion 164. An upper end of the front confronting portion 105 is disposed at substantially the same height as that of the upper surface 350 of the cam body 101. On the other hand, an upper end of the rear confronting portion 106 is disposed at the same height as that of the horizontal surface 165 of the third cam portion 164.

(4) Link Members

The respective left-hand fixing members 152 and the left-hand fixing/contact and spacing translation cam 153 are connected to each other by link members 181 as shown in FIGS. 14 to 16.

The connecting shaft 159 of the left-hand fixing member 152 is inserted into one end of the link member 181 so as to rotate within a predetermined angular range. Specifically, a substantially fan-shaped hole 182 is formed in one end portion of the link member 181. The connecting shaft 159 has a keyhole shape as viewed from the side which has a projection on a circumferential surface thereof. In addition, by the connecting shaft 159 being inserted in the hole 182, the link member 181 is allowed to rotate about the connecting shaft 159 within a predetermined angle range. On the other hand, a connecting shaft 183 is formed at the other end portion of the link member 181 so as to project rightwards. The connecting shaft 183 is inserted into the guide hole 75 in the body frame 62 and is fitted in the guide groove 161 at a distal end portion thereof.

The respective right-hand fixing members 172 and the right-hand fixing/contact and spacing translation cam 153 are connected to each other by link members 184 as shown in FIGS. 17 and 18.

The connecting shaft 179 of the right-hand fixing member 172 is inserted into one end of the link member 184 so as to rotate within a predetermined angular range. Specifically, a substantially fan-shaped hole 185 is formed in the one end portion of the link member 184. The connecting shaft 179 has a keyhole shape as viewed from the side having a projection on a circumferential surface thereof. In addition, by the connecting shaft 179 being inserted into the hole 185, the link member 184 is allowed to rotate about the connecting shaft 179 within a predetermined angular range. On the other hand, a connecting shaft 186 is formed at the other end portion of the link member 184 so as to project leftwards. The connecting shaft 186 is inserted into the guide hole 80 in the body frame 63, and a distal end portion of the connecting shaft 186 is fitted in the guide groove 161.

6. Preventing Members

As shown in FIGS. 14 to 16, the printer 1 includes four preventing members 191. The four preventing members 191 are disposed respectively on a left-hand side of the left-hand fixing members 152.

The preventing members 191 each have an arm-like shape. An insertion hole 192 is formed in one end portion (a proximal end portion) of each of the preventing members 191. Clamping shafts 351 (refer to FIG. 5) are provided on the body frame 62 (refer to FIG. 5) in positions lying forwards of the lower end portions of the process guide grooves 71 at slight intervals, and the clamping shafts 351 so formed are inserted respectively into the insertion holes 192. Because of this, the respective preventing members 191 are supported rotatably about the insertion holes 192 (the clamping shafts 351) by the body frame 62. The preventing members 191 are brought into abutment with the operating portions 171 of the left-hand fixing members 152 (the lock levers 154) at distal end portions thereof from above and then extend in the longitudinal direction. The distal end portion of each of the preventing members 191 extends upwards and is then bent back downwards so as to have a hook shape. In addition, on the right-hand fixing members 172, the lock levers 174 correspond to the preventing members 191 (refer to FIG. 18).

7. Spacing Members

Figure 20:
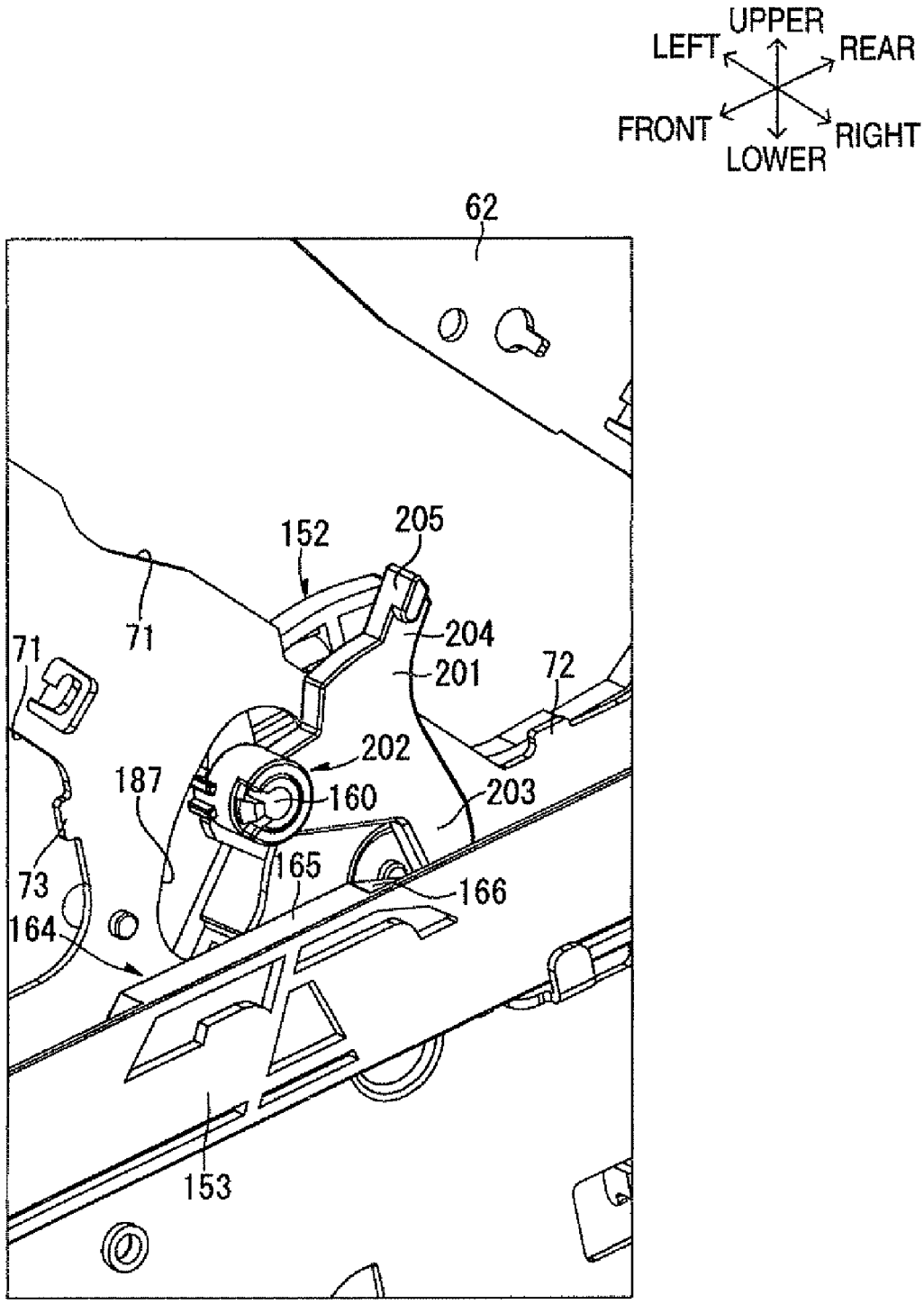
FIG. 20 is a right side view of part of the left-hand body frame, showing a state in which the top cover is closed.
Figure 21:
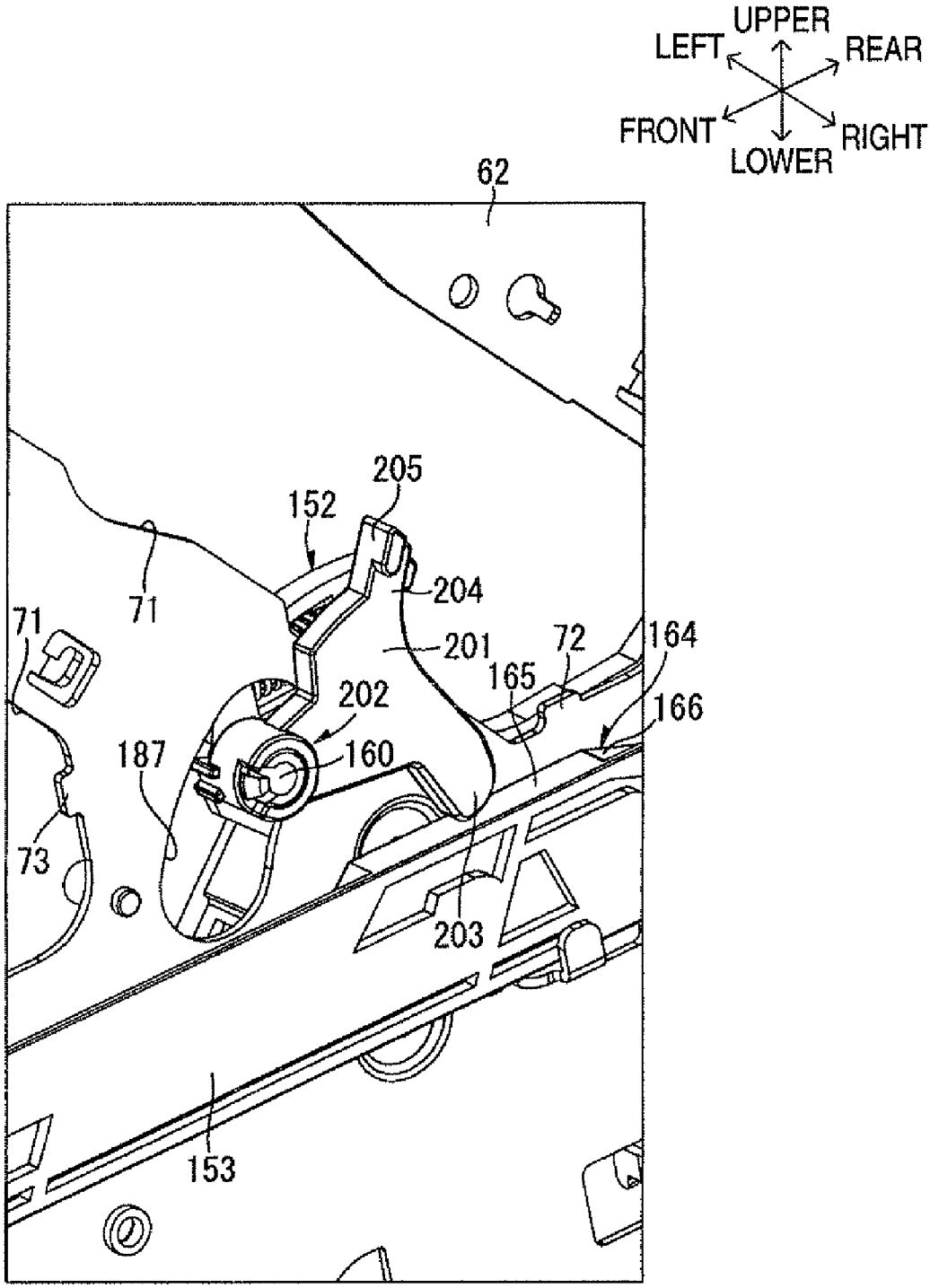
FIG. 21 is a right side view of the part of the left-hand body frame, showing a state in which the top cover is closed after it has once been opened.

FIG. 20 is a right side view of part of the left-hand body frame, showing a state in which the top cover is closed. FIG. 21 is a right side view of the part of the left-hand body frame, showing a state in which the top cover is closed after it has once been opened.

A total of eight spacing members 201 are provided on the printer 1 so as to correspond respectively to the four left-hand fixing members 152 and the four right-hand fixing members 172 (refer to FIG. 17). Since the spacing members 201 provided correspondingly to the left-hand fixing members 152 and the spacing members 201 provided correspondingly to the right-hand fixing members 172 have configurations which are transversely symmetrical with each other, in the following description, the left-hand spacing member 201 will be taken for description of the configuration of the spacing members 201.

The four spacing members 201 are disposed on an inside (a right-hand side) of the left-hand body frame 62 so as to confront the corresponding fixing members 152 in the transverse direction.

The spacing member 201 has a substantially triangular shape. The support portion 160 which is provided on the pressing lever 155 of the left-hand fixing member 152 is inserted relatively rotatably in a corner portion 202 of the spacing member 201, whereby the spacing member 201 is supported rotatably on the support portion 160.

The spacing member 201 is provided so as to extend rearwards from the support portion 160 and is disposed to rest on the upper surface of the fixing/contact and spacing translation cam 153. A lower projecting portion 203 is formed at a rear end portion of the spacing member 201 so as to project downwards. The lower projecting portion 203 is in abutment with the upper surface of the fixing/contact and spacing translation cam 153. In addition, an upper projecting portion 204 is provided at the rear end portion of the spacing member 201 so as to project upwards. A front surface of the upper projecting portion 204 is made to constitute a pressing surface 205.

8. Contact and Spacing Drive Mechanism

As shown in FIGS. 7, 8, 10, 11 and 13, the printer 1 includes the contact and spacing drive mechanism 211 for reciprocating the fixing/contact and spacing translation cams 153 in the longitudinal direction The contact and spacing drive mechanism 211 includes a motor gear 212 which is driven to rotate by a driving force of a contact and spacing motor 229 (refer to FIGS. 22 to 24) which is an example of a motor, an intermediate gear 213 which is provided together with the pinion gear 168 so as to rotate together with the pinion gear 168, a planetary differential clutch 214 for engaging and disengaging the transmission of rotation of the motor gear 212 to the intermediate gear 213, and a clutch engaging lever 215 for switching the operation of the planetary differential clutch 214 to engage and disengage the transmission of rotation of the motor gear 212 to the intermediate gear 213.

As shown in FIGS. 8, 11 and 13, the planetary differential clutch 214 includes a shaft 216 which is held to the holder (not shown) attached to the outer surface of the body frame 62. An input gear 217, an engagement gear 218 and an output gear 219 are supported rotatably on the shaft 216. The engagement gear 218 is disposed on a right-hand side of the input gear 217 and has on an outer circumferential surface thereof a number of gear teeth with which the clutch engaging lever 215 is brought into engagement. The output gear 219 is disposed on a right-hand side of the engagement gear 218. The output gear 219 is formed smaller in diameter than the input gear 217 and is made to mesh with the intermediate gear 213.

The clutch engaging lever 215 is disposed so as to extend in the longitudinal direction above the engagement gear 218. As shown in FIGS. 7 and 10, the clutch engaging lever 215 is supported by a support member 220 at a rear end portion thereof and is provided so as to swing about the support member 220. The support member 220 is fixed to the holder (not shown) attached to the outer surface of the body frame 62. As shown in FIG. 10, a claw 221 is formed on a lower surface of a distal end portion of the clutch engaging lever 215.

The other end of a coil spring 222 which is locked on the holder (not shown) at one end thereof is locked on an intermediate portion of the clutch engaging lever 215. The clutch engaging lever 215 is pressed by the coil spring 222 so as to be raised upwards at the distal end portion thereof. In addition, in such a state that the driving translation cam 94 is disposed in the position shown in FIG. 7, the distal end portion of the clutch engaging lever 215 is raised upwards by virtue of the pressing force of the coil spring 222 and is made to confront the front end portion of the driving translation cam 94 with a predetermined interval defined in front thereof. As shown in FIG. 10, when the driving translation cam 94 is shifted to the frontmost position from this state, the driving translation cam 94 is brought into abutment with the clutch engaging lever 215 on its way to the frontmost position, whereby the distal end portion of the clutch engaging lever 215 is pressed downwards against the pressing force of the coil spring 222 by the driving translation cam 94. As a result, the claw 221 on the clutch engaging lever 215 enters between the gear teeth formed on the engagement gear 218, bringing the clutch engaging lever 215 into engagement with the engagement gear 218.

In such a state that the clutch engaging lever 215 is in engagement with the engagement gear 218, the engagement gear 218 is kept unable to rotate, and the rotational force inputted into the input gear 217 from the motor gear 212 is transmitted to the output gear 219. Namely, the planetary differential clutch 214 transmits the rotational force of the motor gear 212 to the intermediate gear 213. Because of this, specifically, the motor gear 212 is made to rotate forwards by forward drive of the contact and spacing motor 229, so that the pinion gear 168 can be made to rotate forwards together with the intermediate gear 213, whereby the fixing/contact and spacing translation cams 153 are made to be shifted to the rear. On the other hand, the motor gear 212 is made to rotate reversely by reverse drive of the contact and spacing motor 229, so that the pinion gear 168 is made to rotate reversely together with the intermediate gear 213, whereby the fixing/contact and spacing translation cams 153 are made to be shifted to the front.

On the other hand, in such a state that the clutch engaging lever 215 is not in engagement with the engagement gear 218, the rotational force that is inputted into the input gear 217 from the motor gear 212 is transmitted to the engagement gear 218 but is not transmitted to the output gear 219. Namely, the planetary differential clutch 214 disengages the transmission of rotational force of the motor gear 212 to the intermediate gear 213. As this occurs, the output gear 219 is made to rotate freely or idly, the contact and spacing motor 229 (refer to FIGS. 22 to 24) constitutes no load relative to the shift of the fixing/contact and spacing translation cams 153.

9. Second Cover Link Mechanism

As shown in FIGS. 14 to 16, in the printer 1, when the top cover 4 is opened from the closed state, the driving translation cam 94 is shifted rearwards, and the fixing/contact and spacing translation cams 153 are made to be shifted forwards while being linked with the rearward shift of the driving translation cam 94. In addition, when the top cover 4 is closed from the opened state, although the driving translation cam 94 is shifted forwards, the fixing/contact and spacing translation cams 153 are made not to be shifted. To do this, the printer 1 includes the second cover link mechanism 231 as an example of a reciprocating member shifting mechanism.

The second cover link mechanism 231 includes a third cover link member 232 and a fourth cover link member 233.

The third cover link member 232 is a member which extends in a straight line, and a shaft 234 is formed at an intermediate portion of the third cover link member 232 so as to project leftwards. The shaft 234 is supported rotatably on the holder (not shown) attached to the outer surface of the body frame 62. One end portion of the third cover link member 232 is connected to the driving translation cam 94 so as to rotate round an axis which extends along the transverse direction.

The fourth cover link member 233 is a member which extends in a straight line and is provided in a posture extending along the longitudinal direction. A rear end portion of the fourth cover link member 233 is connected to the other end portion of the third cover link member 232 (an opposite end portion of the third cover link member 232 to the one end portion thereof which is connected to the driving translation cam 94) so as to rotate round an axis which extends in the transverse direction. A slider 235 is attached to a front end portion of the fourth cover link member 233. The slider 235 is fitted slidably in the slider guide groove 104 in the fixing/contact and spacing translation cam 153.

In such a state that the top cover 4 is closed and all the developing rollers 8 are spaced apart from the corresponding photosensitive drums 5 (this state will be described later), as shown in FIG. 14, the fixing/contact and spacing translation cam 153 is disposed in the rearmost position thereof. As this occurs, the one end portion of the third cover link member 232 is situated further forwards than the rear end portion of the fourth cover line 233, and the third cover link member 232 and the fourth cover link member 233 forms an acute angle therebetween. In addition, a front end portion of the fourth cover link member 233 is brought into abutment with the projecting portion 103 of the fixing/contact and spacing translation cam 153 from the rear thereof.

When the driving translation cam 94 is shifted rearwards from the state in which the top cover 4 is closed, the one end portion of the third cover link member 232 is shifted rearwards, and the third cover link member 232 rotates about the shaft 234. The rear end portion of the fourth cover link member 233 is pushed forwards by the other end portion of the third cover link member 232 in conjunction with rotation of the third cover link member 233, whereby the projecting portion 103 is pushed forwards by the front end portion of the fourth cover link member 233. By this action, the fixing/contact and spacing translation cam 153 is shifted forwards. Then, when the top cover 4 comes to be opened fully, as shown in FIG. 15, the fixing/contact and spacing translation cam 153 is disposed in the frontmost position thereof.

By the driving translation cam 94 being shifted rearwards while the top cover 4 is opened halfway, the driving translation cam 94 moves away from the clutch engaging lever 215. Then, the distal end portion of the clutch engaging lever 215 is raised upwards, and the engagement of the clutch engaging lever 215 with the engagement gear 218 is released. Because of this, the contact and spacing motor 229 (refer to FIGS. 22 to 24) constitutes no load relative to the shift of the fixing/contact and spacing translation cam 153, whereby a smooth shift of the fixing/contact and spacing translation cam 153 is attained.

In such a state that the top cover 4 is fully opened, as shown in FIG. 15, the one end portion of the third cover link member 232 is situated further rearwards than the rear end portion of the fourth cover link member 233, and the third cover link member 232 and the fourth cover link member 233 forms an obtuse angle therebetween.

When the top cover 4 is closed from the opened state and the driving translation cam 94 is shifted forwards, the one end portion of the third cover link member 232 is shifted forwards, the third cover link member 232 rotates abut the shaft 234. In conjunction with rotation of the third cover link member 232 in this way, the rear end portion of the fourth cover link member 233 is pulled to the rear by the other end portion of the third cover link member 232, the slider 235 at the front end portion of the fourth cover link member 233 moves rearwards along the slider guide groove 104. By this action, as shown in FIG. 16, the driving translation cam 94 is disposed in the frontmost position thereof with the fixing/contact and spacing translation cam 153 left disposed in the frontmost position thereof.

10. Operations of Locking Mechanism (Left-Hand Fixing Members and Right-Hand Fixing Members) and Preventing Members In a state in which the top cover 4 is opened, as shown in FIG. 15, the connecting shafts 183 of the respective left-hand link members 181 are inserted in the straight hole portions 76 (refer to FIG. 5) of the guide holes 75 in the body frame 62, and the distal end portions of the connecting shafts 183 fit in the intersecting groove portions 163 (refer to FIG. 19) of the guide grooves 161. In addition, as shown in FIG. 15, the respective left-hand fixing members 152 fall forwards, retreat from the attachment/detachment paths of the process cartridges 3 and stay in positions (permitting positions) where they do not confront the corresponding process guide grooves 71 (refer to FIG. 5) in the transverse direction. In addition, distal most portions of the respective preventing members 191 are brought into abutment with the corresponding operating portions 171 and stay in positions where they confront the lower end portions of the corresponding process guide grooves 71 in the transverse direction. The respective right-hand fixing members 172 are, as shown in FIG. 18, situated in positions (permitting positions) where the cut-out portions 178 of the lock levers 174 confront the lower end portions of the corresponding process guide grooves 78 in the transverse direction and bottom surfaces of the cut-out portions 178 are substantially at right angles to the direction in which the process guide grooves 78 extend.

In this state, the process cartridge 3 can be attached into and detached from the interior of the body casing 2. When the process cartridge 3 is attached, the protecting portion 30 (refer to FIG. 3) of the process cartridge 3 (the drum cartridge 7) is fitted in the process guide groove 71, the right end portion of the drum shaft 45 is fitted in the process guide groove 74, and the process cartridge 3 is moved obliquely downwards and rearwards. By the series of actions, the process cartridge 3 is let down into the body casing 2 while the protecting portion 30 and the drum shaft 45 are being guided downwards along the process guide grooves 71, 78, respectively. In addition, when the process cartridge is detached, the process cartridge 3 is pulled obliquely upwards and forwards while the protecting portion 30 and the drum shaft 45 are being guided upwards along the process guide grooves 71, 78, respectively.

In the state in which the top cover 4 is opened, since the preventing member 191 confronts the lower end portion of the process guide groove 71 in the transverse direction and the cut-out portion 178 of the lock lever 174 confronts the lower end portion of the process guide groove 78 in the transverse direction, when the process cartridge 3 is attempted to be attached into the interior of the body casing 2, either the protecting portion is brought into abutment with the preventing member 191 or the drum shaft 45 is brought into abutment with the lock lever 174, and the movement of the process cartridge 3 is disrupted at the point in time. Namely, the attachment of the process cartridge 3 into the interior of the body casing 2 is prevented at the point in time at which either the protecting portion 30 is brought into abutment with the preventing member 191 or the drum shaft 45 is brought into abutment with the lock lever 174.

When the top cover 4 is closed from the opened state, the driving translation cam 94 which is being shifted forwards is brought into abutment with the clutch engaging lever 215 while the top cover 4 is closed halfway, and the distal end portion of the clutch engaging lever 215 is then pushed downwards by the driving translation cam 94, whereby the clutch engaging lever 215 is brought into engagement with the engagement gear 218. Because of this, after the top cover 4 has been closed, the fixing/contact and spacing translation cams 153 are allowed to be shifted by virtue of the driving force of the contact and spacing motor 229 (refer to FIGS. 22 to 24).

In addition, by the driving translation cam 94 being shifted forwards while the top cover 4 is closed halfway, the respective drum drive transmission members 92 and the advance and retreat members 112 of the respective developing drive transmission members 93 are made to advance to the advance positions thereof, as shown in FIG. 13. The respective drum drive transmission members 92 are connected to the corresponding flange members 46 (refer to FIG. 3), and the respective advance and retreat members 112 are connected to the corresponding developing passive gears 61. As a result, the photosensitive drums 5 and the developing rollers 9 are made to be driven to rotate.

Even though the top cover 4 is closed from the opened state, the fixing/contact and spacing translation cams 153 are not shifted from the frontmost position. Because of this, in a state resulting immediately after the top cover 4 has been closed, the fixing/contact and spacing translation cams 153 are left disposed in the frontmost position, and hence, the respective left-hand fixing members 152 and the respective right-hand fixing members 172 are disposed in the permitting positions where they permit the attachment or detachment of the process cartridges 3 into or from the interior of the body casing 2.

Then, when the fixing/contact and spacing translation cams 153 are shifted rearwards by forward rotational drive of the contact and spacing motor 229 after the top cover 4 has been closed, the distal end portions of the connecting shafts 183 are shifted rearwards in the straight hole portions 76 of the guide holes 75 (refer to FIG. 5) in the body frame 62 while left fitted in the intersecting groove portions 163. By this action, the respective link members 181 rotate so as to be raised at the one end portions thereof, and the respective left-hand fixing members 152 rotate rearwards about the projecting portions 74 (refer to FIG. 5) formed on the body frame 62 in conjunction with rotation of the link members 181. As a result, as shown in FIG. 14, the respective left-hand fixing members 152 are disposed in the preventing positions on the attachment and detachment paths of the process cartridges 3 (the positions where the attachment and detachment of the process cartridges 3 into and from the interior of the body casing 2 are prevented), and the front ends of the distal end portions of the lock levers 154 are brought into abutment of the protecting portions 30 of the process cartridges 3, whereby the protecting portions 30 are pressed against obliquely downwards and rearwards.

In addition, in conjunction with rotation of the respective left-hand fixing members 152, the operating portions 171 are shifted leftwards relative to the corresponding preventing members 191, and the respective preventing members 191 rotate such that the distal end portions thereof are lowered and are shifted to the positions where the operating portions 171 are allowed to be brought into abutment with the bent portions at the distal end portions of the corresponding preventing members 191. As a result, the process cartridges 3 are allowed to move downwards, and the protecting portions 30 are then brought into abutment with the abutment portions 72, 73, whereby the process cartridges 3 are fixed in place in those positions as shown by broken lines in FIG. 5.

On the other hand, the connecting shafts 186 of the respective right-hand link members 184 are left fitted in the intersecting groove portions 163 of the corresponding guide grooves 161 at the distal end portions thereof. Because of this, when the fixing/contact and spacing translation cam 153 is shifted rearwards, the distal end portions of the connecting shafts 186 are shifted rearwards in the straight hole portions 81 of the guide grooves 80 (refer to FIG. 17) on the body frame 63 while left fitted in the intersecting groove portions 163. By this action, the respective link members 184 rotate such that the one end portions thereof are raised, and in conjunction with rotation of the link members 184 in this way, the respective right-hand fixing members 172 rotate rearwards about the projecting portions 79 (refer to FIG. 18) formed on the body frame 63. As a result, as shown in FIG. 17, the respective right-hand fixing members 72 are disposed in the preventing positions where the attachment and detachment of the process cartridges 3 into and from the interior of the body casing 2 are disrupted, and the front end portions of the cut-out portions 178 of the lock levers 174 are brought into abutment with the drum shafts 45, whereby the drum shafts 45 are pressed against obliquely downwards and rearwards. By this action, the photosensitive drums 5 are fixed on both the left- and right-hand sides thereof.

When the top cover 4 is opened from the closed state, by the actions of the first cover link mechanism 140 and the second cover link mechanism 231, the fixing/contact and spacing translation cams 153 are shifted to the frontmost positions, whereby the respective left-hand fixing members 152 and the respective right-hand fixing members 172 are disposed in the permitting positions.

Figure 22:
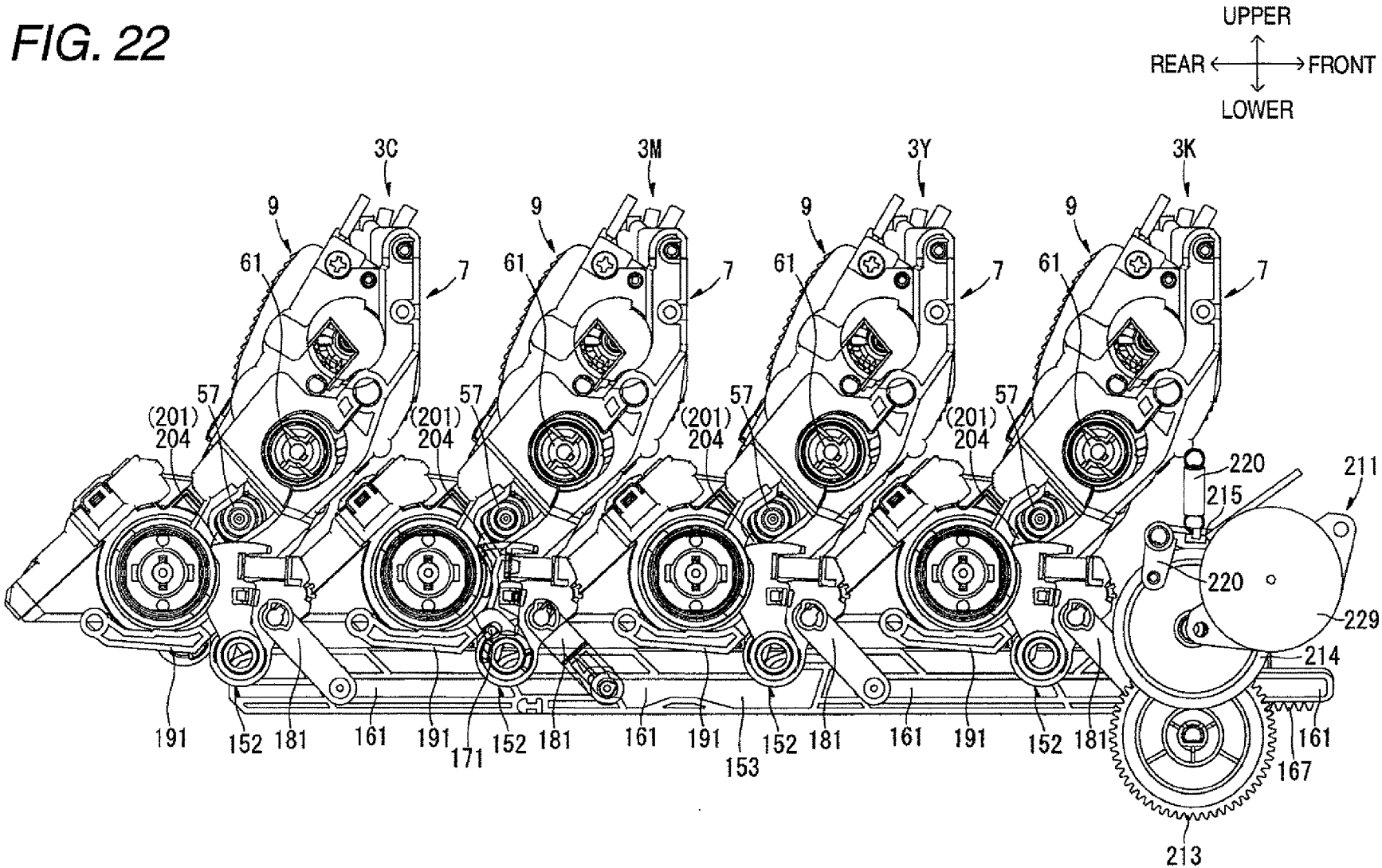
FIG. 22 is a side view of the process cartridges, a locking mechanism and a contact and spacing drive mechanism, showing a state in which all developing rollers are in contact with corresponding photosensitive drums.
Figure 23:
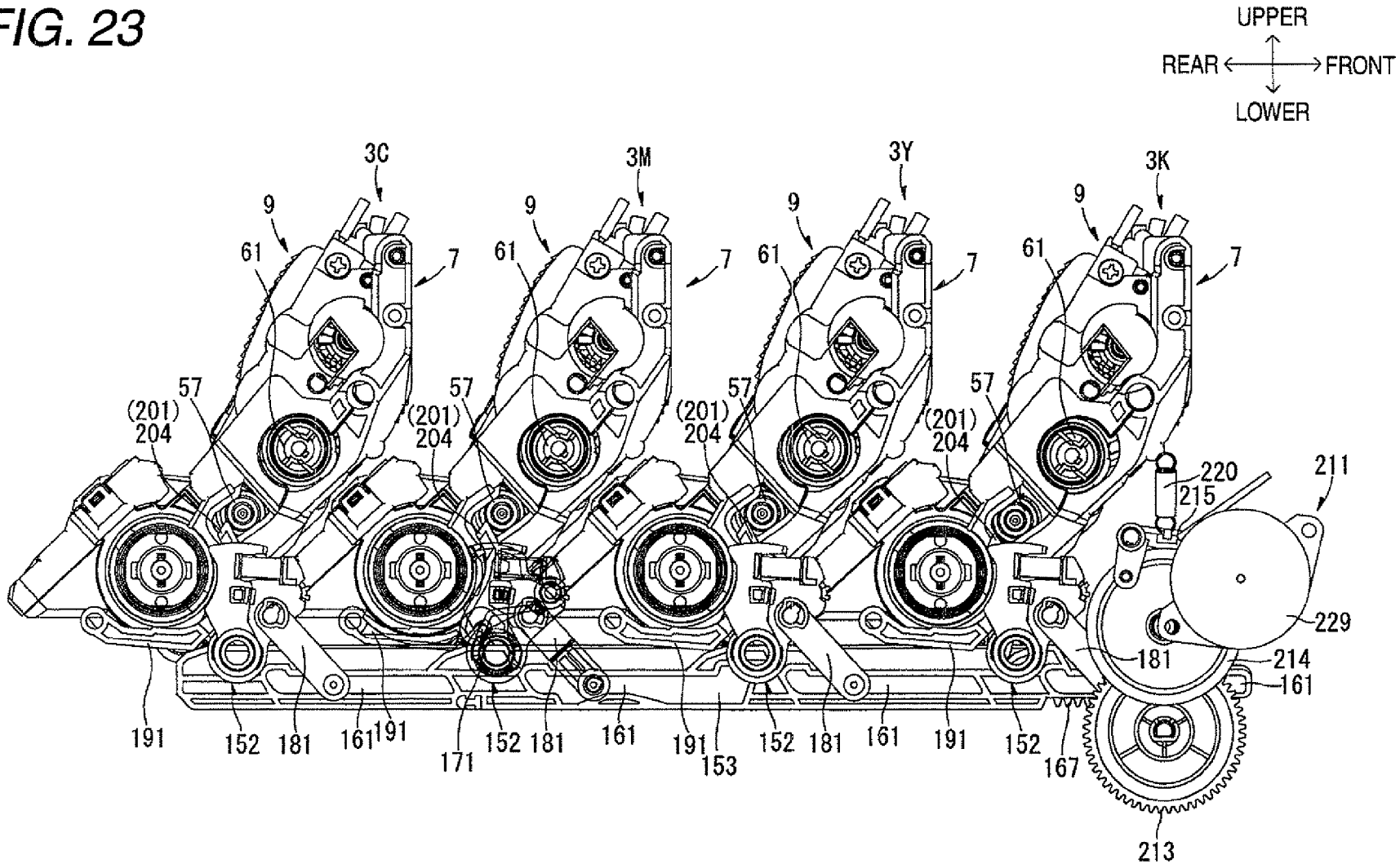
FIG. 23 is a side view of the process cartridges, the locking mechanism and the contact and spacing drive mechanism, showing a state in which the yellow, magenta and cyan developing rollers are spaced apart from the corresponding photosensitive drums.
Figure 24:
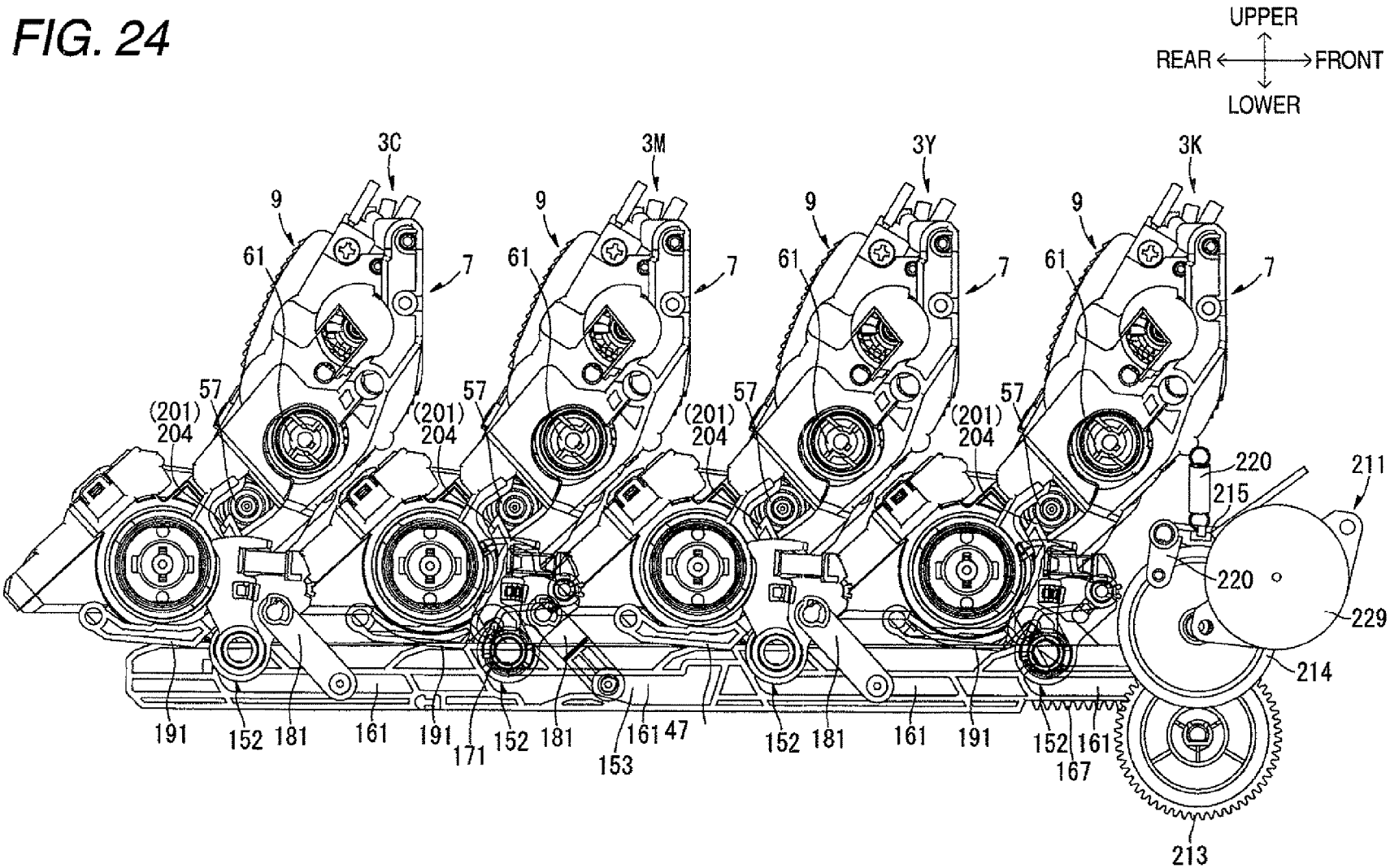
FIG. 24 is a left side view of the process cartridges, the locking mechanism and the contact and spacing drive mechanism, showing a state in which all the developing rollers are spaced apart from the corresponding photosensitive drums.

11. Contact and Spacing Operations of Developing Rollers Relative to Photosensitive Drums FIGS. 22 to 24 are side views of the locking mechanism and the contact and spacing drive mechanism. FIG. 22 shows a state in which all the developing rollers are in contact with the corresponding photosensitive drums, FIG. 23 shows a state in which the yellow, magenta and cyan developing rollers are spaced apart from the corresponding photosensitive drums, and FIG. 24 shows a state in which all the developing rollers are spaced apart from the corresponding photosensitive drums.

In such a state that the top cover 4 is closed, the fixing/contact and spacing translation cams 153 can be shifted by the driving force of the contact and spacing motor 229 (refer to FIG. 22). Even though the fixing/contact and spacing translation cams 153 are shifted rearwards further after the fixing/contact and spacing translation cams 153 are shifted and the connecting shafts 183 of the left-hand link members 181 reach the intersecting hole portions 77 (refer to FIG. 5) of the guide holes 75 in the body frame 62, the distal end portions of the connecting shafts 183 move within the straight groove portions (refer to FIG. 19) of the guide grooves 161, and the postures of the link members 181 do not change. In addition, even though the fixing/contact and spacing translation cams 153 are shifted rearwards further after the connecting shafts 186 of the right-hand link members 184 reach the intersecting hole portions 82 (refer to FIG. 18) of the guide holes 80 on the body frame 63, the distal end portions of the connecting shafts 186 move within the straight groove portions 162 of the guide grooves 161, and the postures of the link members 184 do not change.

In a state resulting immediately after the top cover 4 is closed from the opened state, as shown in FIG. 20, all the spacing members 201 are in positions (contact permitting positions) in which the lower projecting portions 203 are in abutment with the upper surfaces 350 of the fixing/contact and spacing translation cams 153 (refer to FIG. 19) (but are not in abutment with the third cam portions 164) and the upper projecting portions 204 are lowered relatively. Because of this, as shown in FIG. 22, a state results in which the upper projecting portions 204 of the respective spacing members 201 are spaced apart from the developing bearing members 57, 58 which project from both the left- and right-hand sides of the developing cartridges 9 and all the developing rollers 8 (refer to FIG. 1) are in contact with the corresponding photosensitive drums 5. In addition, the respective left-hand fixing members 152 and the respective right-hand fixing members 172 are disposed in the permitting positions.

When the fixing/contact and spacing translation cams 153 are shifted rearwards by forward rotational drive of the contact and spacing motor 229, the lower projecting portions 203 of the spacing members 201 which correspond respectively to the yellow process cartridge 3Y, the magenta process cartridge 3M and the cyan process cartridge 3C move over the inclined surfaces 166 of the third cam portions 164 and then move on to the inclined surfaces 166 from the horizontal surfaces 165. In association with this, as shown in FIG. 21, the spacing members 201 are disposed in positions (spacing positions) in which the lower projecting portions 203 are brought into abutment with the horizontal surfaces 165, whereby the upper projecting portions 204 are raised upwards relatively. As a result, as shown in FIG. 23, the pressing surfaces 205 of the upper projecting portions 204 press against the developing bearing members 57, 58 of the yellow, magenta and cyan developing cartridges 9 from therebelow in such a state the pressing surfaces 205 lie along from the rear to vertical direction of the corresponding developing bearing members 57, 58. As a result, the yellow, magenta and cyan developing cartridges 9 are raised upwards, and the developing rollers 8 which are installed in those developing cartridges 9 are spaced apart from the corresponding photosensitive drums 5. As this occurs, the developing roller 8 installed in the black developing cartridge 9 remains in contact with the corresponding photosensitive drum 5.

In addition, the respective left-hand fixing members 152 and the respective right-hand fixing members 172 are displaced from the permitting positions to the preventing positions while the state in which all the developing rollers 8 are in contact with the corresponding photosensitive drums 5 changes to the state in which the yellow, magenta and cyan developing rollers 8 are spaced apart from the corresponding photosensitive drums 5.

When the fixing/contact and spacing translation cams 153 are shifted rearwards further from this state, the lower projecting portion 203 of the spacing member 201 which corresponds to the black process cartridge 3K moves over the inclined surface 166 of the third cam portion 164 and then moves on to the inclined surface 166 from the horizontal surface 165. By this action, the spacing member 201 is disposed in a position (a spacing position) in which the lower projecting portion 203 is brought into abutment with the horizontal surface 165, whereby the upper projecting portion 204 is raised upwards relatively. As a result, as shown in FIG. 24, the pressing surface 205 of the upper projecting portion 204 presses against the developing bearing members 57, 58 of the black developing cartridge 9 from therebelow in such a state the pressing surface 205 lies along from the rear to vertical direction of the corresponding developing bearing members 57, 58. As a result, the black developing cartridge 9 is raised upwards, and then, all the developing rollers 8 which are spaced apart from the corresponding photosensitive drums 5.

When the contact and spacing motor 299 is driven to rotate reversely, so as to shift the fixing/contact and spacing translation cams 153 forwards from the state in which all the developing rollers 8 are spaced apart from the corresponding photosensitive drums, the respective developing cartridges 9, the respective left-hand fixing members 152, the respective right-hand fixing members 172 and the respective spacing members 201 will perform the operations that have been described heretofore in a reverse way.

12. Control System

Figure 25:
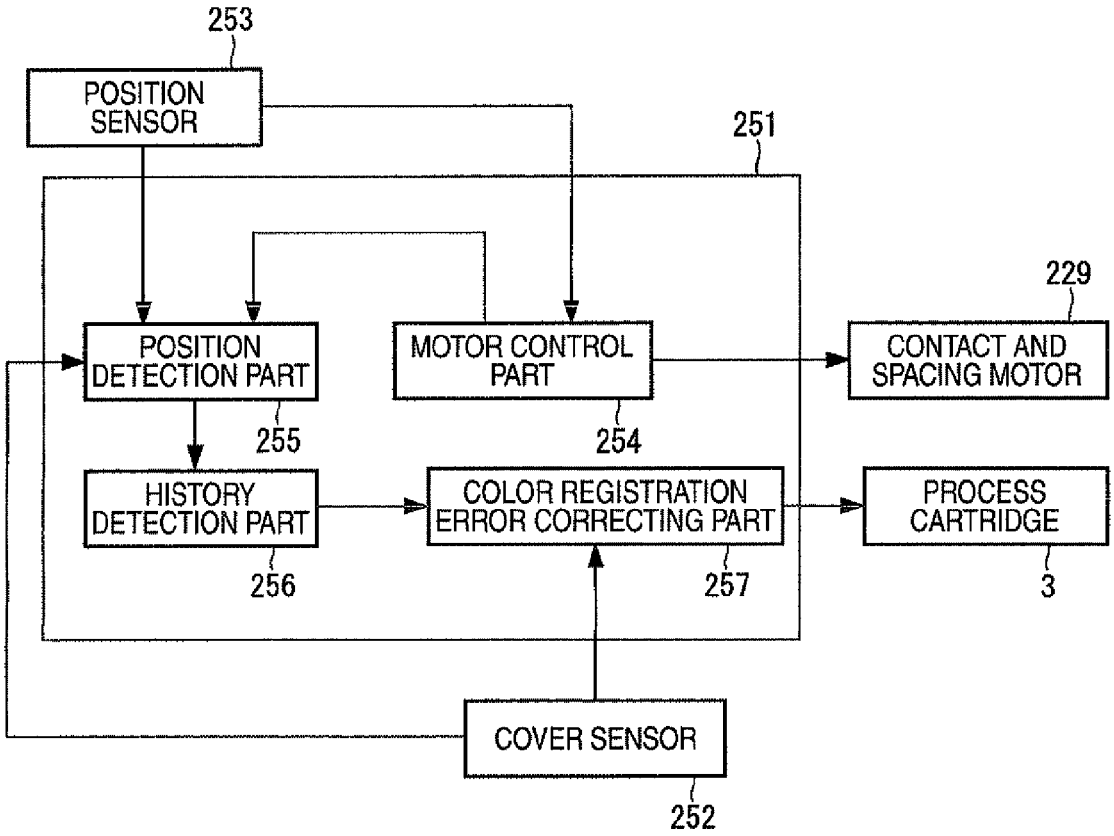
FIG. 25 is a block diagram showing a control system of the printer.

FIG. 25 is a block diagram showing a control system of the printer.

The printer 1 includes a micro computer 251 which contains a CPU, RAM, ROM and the like.

In addition, the printer includes a cover sensor 252 for detecting the opening and closure of the top cover 4. The cover sensor 252 is made up of, for example, a microswitch and is made to output an ON signal in such a state that the top cover 4 is closed and output an OFF signal in such a state that the top cover 4 is opened. Output signals of the cover sensor 252 are made to be inputted into the microcomputer 251.

Further, the printer 1 includes a position sensor 253 which is made up of a reflection type optical sensor. The position sensor 253 is disposed in a position where the position sensor 253 is made to confront the detection hole 83 (refer to FIG. 4) formed in the right-hand body frame 63 from the right-hand side. The position sensor 253 emits a detection light beam towards the detection hole 83.

In such a state that the fixing/contact and spacing translation cams 153 are disposed in the rearmost positions (the position shown in FIG. 14), the rear confronting portion 106 (refer to FIG. 19) of the cam side plate 102 of the fixing/contact and spacing translation cam 153 confronts the detection hole (refer to FIG. 4). As this occurs, the position sensor 253 receives a detection light beam which is reflected on the rear confronting portion 106 via the detection hole 83 and outputs a signal (an ON signal) which signals an ON state as an example of a first state. In addition, in such a state that the fixing/contact and spacing translation cam 153 are shifted forwards by a predetermined amount or more from the rearmost position, the rear confronting portion 106 is disposed further forwards than the detection hole 83 and hence does not confront the detection hole 83. As this occurs, the position sensor 253 does not receive the detection light beam and outputs a signal (an OFF signal) which signals an OFF state as an example of a second state. The output signals so outputted by the position sensor 253 are made to be inputted into the microcomputer 251.

Several units necessary to drive the process cartridge 3 are connected to the microcomputer 251 as control target objects, and those units include a drum motor for generating drive to be inputted into the photosensitive drum 5 (refer to FIG. 1), a developing motor for generating drive to be inputted into the developing cartridge 9 (refer to FIG. 1), circuits for applying voltages to the scorotron-type charger 6 (refer to FIG. 1) and the developing roller 8 (refer to FIG. 1) and the like. In addition, the contact and spacing motor 229 is also connected to the microcomputer 251 as a control target object.

The microcomputer 251 includes substantially a motor control part 254 as an example of a motor drive unit for controlling the drive of the contact and spacing motor 229 based on an output signal from the position sensor 253, a position detection part 255 as an example of a position detection unit for detecting the position of the fixing/contact and spacing translation cam 153 based on an output signal from the position sensor 253 and a driving time of the contact and spacing motor 229, a history determination part 256 as an example of a history detection unit for detecting on the existence of a history showing the opening and closure of the top cover 4 (refer to FIG. 1) in such a state that the power supply to the printer 1 is left off based on the position of the fixing/contact and spacing translation cam 153 detected by the position detection part 255, and a color registration error correcting part 257 as an example of a correcting operation execution unit for executing a correcting operation for correcting the color registration error based on the determination result by the history determination part 256 and the output signal of the cover sensor 252. Any of the motor control part 254, the position detection art 255, the history determination part 256 and the color registration error correcting part 257 is a functioning part which is realized through software by the CPU executing programs.

13. Opening and Closure History Determination Operation

Figure 26:
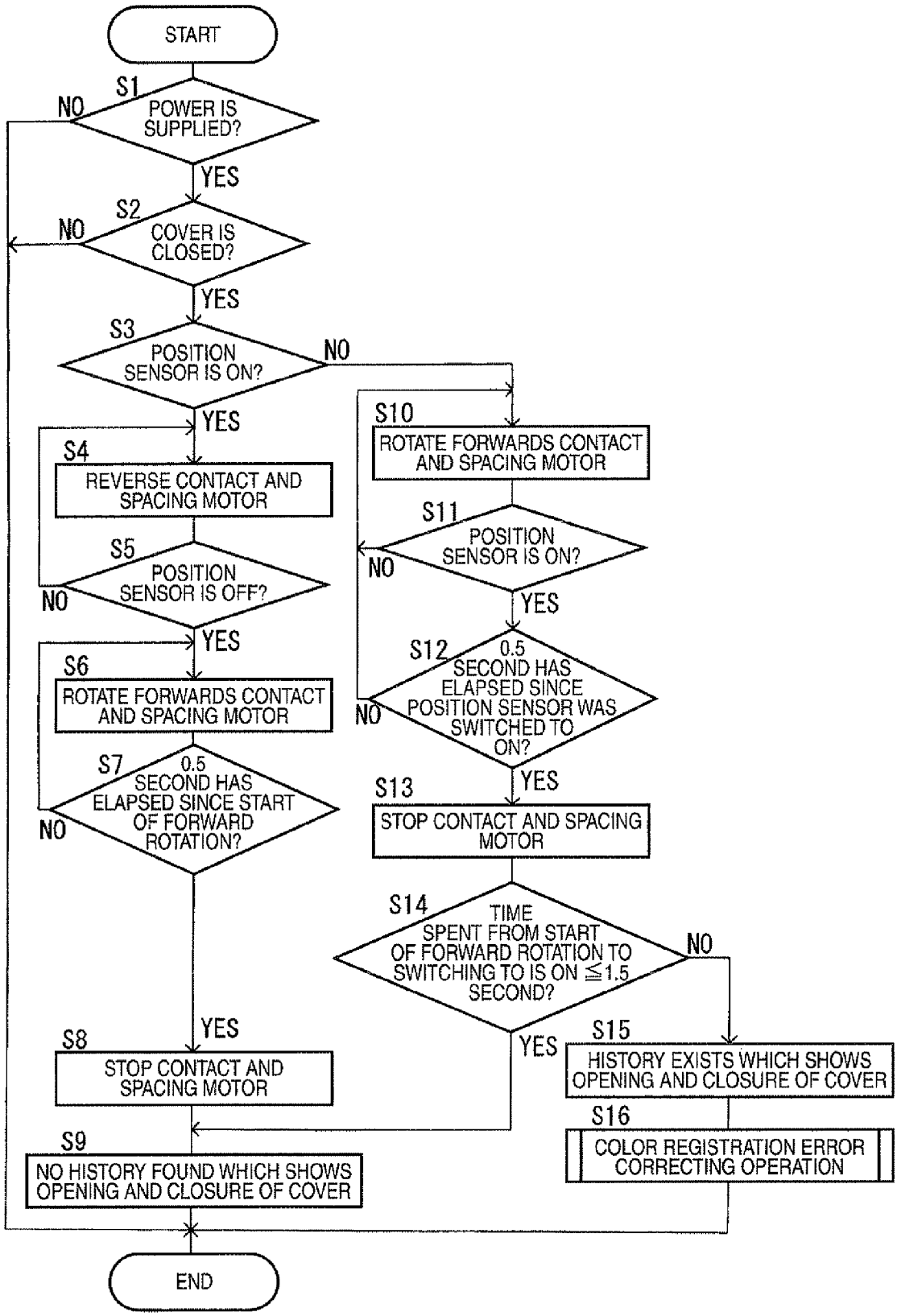
FIG. 26 is a flowchart of an opening and closure history determination operation.

FIG. 26 is a flowchart of an opening and closure history determination operation.

An opening and closure determination operation is implemented, for example, in response to introduction of the power supply to the printer 1.

When the power supply to the printer 1 is switched on, firstly, the output signal of the cover sensor 252 is referred to by the position detection part 255, so as to determine whether or not the top cover 4 is closed (whether or not the output signal from the cover sensor 252 is the ON signal) (S2). If the top cover 4 is closed, following this, the output signal of the position sensor 253 is referred to, so as to determine whether or not the output signal is the ON signal (S3). If the top cover 4 is opened, the history determination operation is ended immediately.

If the output signal of the position sensor 253 is the ON signal, the position detection part 255 determines that the fixing/contact and spacing translation cams 153 are disposed in the rearmost positions. In addition, the position detection part 255 also determines that the respective left-hand fixing members 152 and the respective right-hand fixing members 172 are disposed in the permitting positions. In addition, the motor control part 254 drives the contact and spacing motor 229 to rotate reversely (S4). By the contact and spacing motor 229 being so driven, the fixing/contact and spacing translation cams 153 are shifted forwards. Since, when the fixing/contact and spacing translation cams 153 are shifted forwards by a predetermined amount from the rearmost positions, the rear confronting portion 106 (refer to FIG. 9) of the cam side plate 102 of the fixing/contact and spacing translation cam 153 is made to confront the detection hole 83 (refer to FIG. 4), in response thereto, the output signal of the position sensor 253 is switched from the ON signal to the OFF signal. Specifically, when the contact and spacing motor 229 is driven to rotate reversely over 0.5 second from the state in which the fixing/contact and spacing translation cams 153 are disposed in the rearmost positions, the fixing/contact and spacing translation cams 153 are shifted forwards by the predetermined amount, whereby the rear confronting portion 106 of the cam side plate 102 of the fixing/contact and spacing translation cam 153 comes to confront the detection hole 83, and the output signal of the position sensor 253 is switched from the ON signal to the OFF signal.

The motor control part 254 determines repeatedly whether or not the output signal of the position sensor 253 has been switched from the ON signal to the OFF signal while the contact and spacing motor 299 is being driven to rotate reversely (S5). When the output signal of the position sensor 253 is switched from the ON signal to the OFF signal, the motor control part 254 drives the contact and spacing motor 229 to rotate forwards (S6), whereby the fixing/contact and spacing translation cams 153 are shifted rearwards.

The motor control part 254 determines repeatedly whether or not 0.5 second has elapsed from a start of forwarding rotation of the contact and spacing motor 229 while the contact and spacing motor 299 is being driven to rotate forwards (S7). After 0.5 second has elapsed, the motor control part 254 stops the contact and spacing motor 229 (S8). When the contact and spacing motor 229 is driven to rotate forwards over 0.5 second, the fixing/contact and spacing translation cams 153 are certainly shifted to the rearmost positions.

In addition, since, when the power supply to the printer 1 is switched on (when the history determination operation is started), the fixing/contact and spacing translation cams 153 are disposed in the rearmost positions and the respective left-hand fixing members 152 and the respective right-hand fixing members 172 are disposed in the permitting positions, the history determination unit 256 determines that there has existed no history showing the opening and closure of the top cover 4 while the power supply is left off (S9), and the history determination operation is ended.

On the other hand, if the position detection part 244 determines that the output signal of the position sensor 253 is the OFF signal after the history determination operation is started and the top cover 4 is determined as being closed, the motor control part 254 drives the contact and spacing motor 229 to rotate forwards (S10). This causes the fixing/contact and spacing translation cams 153 to be shifted rearwards.

The motor control part 254 determines repeatedly whether or not the output signal of the position sensor 253 has been switched form the OFF signal to the ON signal while the contact and spacing motor 229 is being driven to rotate forwards (S11). When the output signal of the position sensor 253 is switched from the OFF to the ON signal, the motor control part 254 determines whether or not 0.5 second has elapsed from the point in time at which the output signal of the position sensor 253 was so changed (S12). If 0.5 second is determined to have elapsed from the switching of output signals of the position sensor 253, the motor control part 254 stops the contact and spacing motor 229. By the contact and spacing motor 229 being driven to rotate forwards, the fixing/contact and spacing translation cams 153 are disposed in the rearmost positions.

Then, the position detection part 244 determines whether or not time spent from the point in time at which the contact and spacing motor 229 was started to be driven to rotate forwards to the point in time at which the output signal of the position sensor 253 was switched is 1.5 seconds or less (S14).

As has been described before, when the contact and spacing motor 229 is driven to rotate reversely over 0.5 second from the state in which the fixing/contact and spacing translation cams 153 are disposed in the rearmost positions, the output signal of the position sensor 253 is switched from the ON signal to the OFF signal. When the contact and spacing motor 229 is driven to rotate reversely over 0.5 second from the switching of output signals of the position sensor 253, the spacing member 201 corresponding to the black developing cartridge 9 is disposed in the contact permitting position, whereby the black developing roller 8 is brought into contact with the corresponding photosensitive drum 5. In addition, when the contact and spacing motor 229 is driven to rotate reversely over 1.5 seconds from the switching of output signals of the position sensor 253, the spacing members 201 corresponding respectively to the yellow, magenta and cyan developing cartridges 9 are disposed in the contact permitting positions, and then, all the developing rollers 8 are in contact with the corresponding photosensitive drums 5.

Consequently, if the output signal of the position sensor 253 is switched from the OFF signal to the ON signal within 1.5 seconds from the point in time at which the contact and spacing motor 229 was started to be driven to rotate forwards, it can be determined that the position of the fixing/contact and spacing translation cams 153 resulting when the power supply to the printer 1 is switched on is not the frontmost position but is the intermediate position between the frontmost position and the rearmost position, that is, the position where at least the spacing member 201 corresponding to the black developing cartridge 9 is disposed in the contact permitting position. In addition, it can also be determined that the respective left-hand fixing members 151 and the respective right-hand fixing members 172 have been disposed in the preventing positions.

In addition, in the printer 1, when the formation of the image on to the sheet P has been finished, the contact and spacing motor 229 is driven by the motor control part 254, whereby the fixing/control and spacing translation cams 153 are shifted to the rearmost positions. For example, in the event that the power supply is switched off while the fixing/contact and spacing translation cams 153 are shifted to the rearmost positions halfway, the fixing/contact and spacing translation cams 153 are disposed in intermediate positions immediately after the power supply to the printer 1 has been switched on.

If the time spent from the point in time at which the contact and spacing motor 229 was started to be driven to rotate forwards until the point in time at which the output signal of the position sensor 253 was switched is 1.5 seconds or less, the position detection part 244 determines that the fixing/contact and spacing translation cams 153 were disposed in the intermediate positions when the power was supplied to the printer 1. In addition, the position detection part 244 also determines that the respective left-hand fixing members 152 and the respective right-hand fixing member 172 were disposed in the preventing positions when the power supply to the printer 1 was switched on. Then, the history determination part 256 determines based on the determination so made by the position detection part 244 that there has existed no history showing the opening and closure of the top cover 4 while the power supply was left off (S9), and the history determination operation is ended.

If the time spent from the point in time at which the contact and spacing motor 229 was started to be driven to rotate forwards until the point in time at which the output signal of the position sensor 253 was switched is more than 1.5 seconds, the position detection part 244 determines that the fixing/contact and spacing translation cams 153 were disposed in the frontmost positions when the power was supplied to the printer 1. In addition, the position detection part 244 also determines that the respective left-hand fixing members 152 and the respective right-hand fixing member 172 were disposed in the permitting positions when the power supply to the printer 1 was switched on. Then, the history determination part 256 determines based on the determination so made by the position detection part 244 that there has existed a history showing the opening and closure of the top cover 4 while the power supply was left off (S15). Then, after the operation for correcting the color registration error (the color registration error correcting operation) has been implemented, the history determination operation is ended.

In the color registration error correcting operation, for example, timings at which respective toner images are formed (timing at which electrostatic latent images are formed on to the photosensitive drums 5) are corrected such that correction enabling toner images (registration marks, patches) of respective colors are formed on the conveyer belt 12 at the same time and that intervals at which the adjacent correction enabling toner images are aligned become predetermined intervals.

14. Function and Advantage

As has been described heretofore, the top cover 4 is provided on the body casing 2 so as to be opened and closed. The process cartridges 3 are attached and detached into and from the interior of the body casing 2 by opening the top cover 4. In addition, the left-hand fixing members 152, the right-hand fixing members 172 and the one-way link mechanism which includes the first cover link mechanism 140, the second cover link mechanism 231, the link members 181 and the fixing/contact and spacing translation cams 153 are provided in the interior of the body casing 2.

The left-hand fixing members 152 and the right-hand fixing members 172 are allowed to be shifted between the preventing positions and the permitting positions. By the left-hand fixing members 152 and the right-hand fixing members 172 being disposed in the preventing positions, the process cartridges 3 can be fixed in place within the body casing 2. By this action, the detachment of the process cartridges 3 from the interior of the body casing 2 is prevented. By the process cartridges 3 being fixed to the body casing 2, the process cartridges 3 are disposed in the constant positions within the body casing 2, and therefore, the toner image made up of the toner images of respective colors can be formed on the sheet P with good accuracy. On the other hand, by the left-hand fixing members 152 and the right-hand fixing members 172 being disposed in the permitting positions, the fixing of the process cartridges 3 to the body casing 2 can be released, whereby the detachment of the process cartridges 3 from the interior of the body casing 2 is enabled.

The left-hand fixing members 152 and the right-hand fixing members 172 are disposed in the preventing positions with the fixing/contact and spacing translation cams 153 disposed in the rearmost positions. On the other hand, the left-hand fixing members 152 and the right-hand fixing members 172 are disposed in the permitting positions with the fixing/contact and spacing translation cams 153 disposed in the frontmost positions. Because of this, by the fixing/contact and spacing translation cams 153 being made to reciprocate in a straight line between the rearmost positions and the frontmost positions, the left-hand fixing members 152 and the right-hand fixing members 172 can be made to be displaced to the preventing positions and the permitting position in an ensured fashion.

In addition, when the top cover 4 is opened from the state in which the top cover 4 is closed and the fixing/contact and spacing translation cams 153 are disposed in the rearmost positions, the second cover link mechanism 231 causes the fixing/contact and spacing translation cams 153 to be shifted from the rearmost positions to the frontmost positions. On the other hand, when the top cover is closed form the opened state, the second cover link mechanism 231 does not cause the fixing/contact and spacing translation cams 153 to be shifted from the frontmost positions. Consequently, by detecting the position of the fixing/contact and spacing translation cams 153, the position of the left-hand fixing members 152 and the right-hand fixing members 172 can be detected indirectly based on the position of the fixing/contact and spacing translation cams 153 so detected.

The position sensor 253 for detecting the position of the fixing/contact and spacing translation cams 153 outputs the signal signaling the ON state when the fixing/contact and spacing translation cams 153 are disposed in the rearmost positions and outputs the signal signaling the OFF state when the fixing/contact and spacing translation cams 153 are disposed in the positions which lie apart the predetermined amount or more from the rearmost positions. Because of this, it can be determined whether the fixing/contact and spacing translation cams 153 are disposed in the rearmost positions or in the positions lying apart the predetermined amount or more from the rearmost positions based on the status of the output signal from the position sensor 253.

When the power is supplied to the printer 1, in response thereto, the position detection part 255 detects the position of the fixing/contact and spacing translation cams 153 at that point in time, whereby the positions of the left-hand fixing members 152 and the right-hand fixing members 172 are detected indirectly based on the position of the fixing/contact and spacing translation cams 153 so detected. In addition, based on the positions of the left-hand fixing members 152 and the right-hand fixing members 172, the history determination part 256 determines whether or not there has existed a history showing the opening and closure of the top cover 4 while the power supply was left off.

Specifically, the contact and spacing motor 299 is driven in response to the power being supplied to the printer 1, and the fixing/contact and spacing translation cams 153 are shifted to the one end positions. Then, the position detection part 255 detects the position of the fixing/spacing and contact translation cams 153 based on the status of the output signal of the position sensor 253 when the power supply was switched on and the driving time of the contact and spacing motor 229 from the point in time at which the contact and spacing motor 229 was started to be driven to rotate until the point in time at which the status of the output signal of the position sensor 253 was switched from the OFF state to the ON state, whereby the positions of the left-hand fixing members 152 and the right-hand fixing members 172 resulting immediately after the power supply was switched on are detected indirectly.

When the top cover 4 is opened and closed while the power supply is left off, in the state resulting immediately after the power supply has been switched on, the left-hand fixing members 152 and the right-hand fixing members 172 are disposed in the permitting positions. Because of this, in the event that the left-hand fixing members 152 and the right-hand fixing members 172 are disposed in the permitting positions immediately after the power supply has been switched on, it can be determined that the top cover 4 was opened and closed while the power supply was left off. On the other hand, in the event that the left-hand fixing members 152 and the right-hand fixing members 172 are disposed in the preventing positions immediately after the power supply has been switched on, it can be determined that the top cover 4 was neither opened nor closed while the power supply was left off. Consequently, the existence of a history showing the opening and closure of the top cover 4 while the power supply was left off can be determined accurately.

The process cartridges 3 are provided so as to correspond respectively to the respective colors of black, yellow, magenta and cyan. There may occur an opportunity in which the respective process cartridges 3 are attached and detached into and from the interior of the body casing 2 by opening the top cover 4. When the process cartridges 3 are attached and detached, there is a fear that there is produced a positioning error of the process cartridges 3 so attached within the body casing 2 and this process cartridge positioning error triggers a color registration error attributed thereto in forming an image after the attachment and detachment of the process cartridges 3. Then, in the event that the top cover 4 was opened and closed while the power supply was left off, the correcting operation to register the positions where images are formed by the process cartridges 3, that is, the operation to correct the color registration error is implemented. By this implementation of the color registration error correction, the occurrence of a color registration error attributed to the attachment and detachment of the process cartridges 3 can be prevented. In addition, since no color registration error correcting operation has to be implemented when the top cover 4 was not opened and closed, the time spent from the point in time at which the power supply is switched on until the image is formed can be shortened. Further, the wastage of toner due to the color correcting operation being implemented wastefully can be prevented.

The photosensitive drum 5 and the developing roller 8 are provided in the process cartridge 3. The developing roller 8 is disposed so as to confront the photosensitive drum 5 and develops an electrostatic latent image formed on the photosensitive drum 5. In addition, the spacing members 201 are provided within the body casing 2 so as to correspond respectively to the process cartridges. The respective spacing members 201 are shifted to the spacing positions where the developing rollers 8 are spaced apart from the corresponding photosensitive drums 5 and the contact permitting positions where the contact of the developing rollers 8 with the corresponding photosensitive drums 5 is permitted by the fixing/contact and spacing translation cams 153 being reciprocated in a straight line. Because of this, the contact and separation of the developing rollers 8 with and from the corresponding photosensitive drums 5 can be switched by the reciprocating straight-line movement of the fixing/contact and spacing translation cams 153.

In addition, the positions of the fixing/contact and spacing translation cams 153 are changed by the drive of the contact and spacing motor 229 being controlled based on the switching of the status of the output signal of the position sensor 253. Specifically, the positions of the fixing/contact and spacing translation cams 153 are switched between the position where the all the spacing members 201 are disposed in the spacing positions, the position where the one spacing member 201 is disposed in the spacing position and the remaining spacing members 201 are disposed in the contact permitting positions, and the position where all the spacing members 201 are disposed in the contact permitting positions. In this way, the position sensor 253 does not have to be provided so as to correspond to the respective positions of the fixing/contact and spacing translation cams 153, and the switching of the position of the fixing/contact and spacing members 153 can be attained based on the output signal from the one position sensor 253.

15. Other Exemplary Embodiments

Thus, while the exemplary embodiment of the present invention has been described heretofore, the present invention can be implemented based on other exemplary embodiments.

For example, in the exemplary embodiment described above, the left-hand fixing members 152 and the right-hand fixing members 172 are made to constitute the example of the displacement members. However, any members may be adopted as the displacement members, provided that the replacement members can be displaced to the preventing position where the attachment and detachment of the process cartridges 3 are prevented and the permitting position where the attachment and detachment thereof are permitted.

For example, the drum drive transmission members 92 are provided so as to be made to advance to the advance position where they advance towards the processing cartridges 3 and retreat to the retreat position where they retreat from the process cartridges 3 by the reciprocating movement of the driving translation cam 94. In such a state that the drum drive transmission members 92 are disposed in the advance positions, since the drum drive transmission members 92 are connected to the flange members 46 (refer to FIG. 3) of the corresponding photosensitive drums 5, the attachment (detachment) of the process cartridges 3 into (from) the interior of the body casing 2 is prevented. On the other hand, in such a state that the drum drive transmission members 92 are disposed in the retreat positions, the drum drive transmission members 92 are spaced apart from the flange members 46, whereby the attachment and detachment of the process cartridges 3 into and from the interior of the body casing 2 is enabled. Consequently, the drum drive transmission members 92 may constitute an example of displacement members.

In addition, the developing drive transmission members 93 (the advance and retreat members 112) are provided so as to be made to advance to the advance position where they advance towards the processing cartridges 3 and retreat to the retreat position where they retreat from the process cartridges 3 by the reciprocating movement of the driving translation cam 94. In such a state that the developing drive transmission members 93 are disposed in the advance positions, since the developing drive transmission members are connected to the developing passive gears 61 (refer to FIG. 3), the attachment (detachment) of the process cartridges 3 into (from) the interior of the body casing 2 is prevented. On the other hand, in such a state that the developing drive transmission members 93 are disposed in the retreat positions, the developing drive transmission members 93 are spaced apart from the developing passive gears 61, whereby the attachment of the process cartridges 3 into the interior of the body casing 2 can be enabled. Consequently, the developing drive transmission members 93 may constitute an example of displacement members.

In addition, the present invention can be applied to an intermediate transfer type color printer in which toner images of respective colors are transferred on to an intermediate transfer belt from respective image carrying members, and thereafter the toner images are transferred on to a sheet from the intermediate transfer belt altogether at one time.

As described above, there is provided an image forming apparatus adapted to become operable with a power supply switched on, the image forming apparatus including an apparatus main body, detachable members detachably provided in the apparatus main body, a cover that is configured to be openable and closable to the apparatus main body for the an attachment and a detachment of the detachable members, displacement members provided in such a manner as to be displaced to a preventing position where the displacement members disrupt the attachment or detachment of the detachable members and a permitting position where the displacement members permit the attachment or detachment of the detachable members, a one-way link mechanism provided in the apparatus main body for displacing the displacement members from the preventing position to the permitting position when the cover is opened from a state in which the cover is closed and the displacement members are disposed in the preventing position and keeping the displacement members in the permitting position when the cover is closed from the state in which the cover is opened, a position detection unit for detecting (directly or indirectly) the position of the displacement members resulting immediately after the power supply is switched on in response to the power supply having been switched on, and a history determination unit for determining on the existence of a history showing the opening and closure of the cover while the power supply was left off based on the position of the displacement members detected by the position detection unit.

According to a second aspect of the present invention, there is provided an image forming apparatus as set forth in the first aspect of the invention, wherein the displacement members are fixing members adapted to be displaced to a fixing state in which the fixing members press against the detachable members so as to fix the detachable members to the apparatus main body and a fixing release state in which the fixing of the detachable members to the apparatus main body is released in such a state that the detachable members are attached in the apparatus main body.

According to a third aspect of the invention, there is provided an image forming apparatus as set forth in the first or second aspect of the invention, wherein the one-way link mechanism includes reciprocating members provided in such a manner as to reciprocate between one end position and the other end position so that when at the one end position, the reciprocating members place the displacement members in the preventing position, while when at the other end position, the reciprocating members place the displacement members in the permitting position, and a reciprocating member shifting mechanism adapted to be linked with a cover opening action when the cover is opened from a state in which the cover is closed and the reciprocating members are disposed in the one end position so as to shift the reciprocating members from the one end position to the other end position and adapted not to be linked with a cover closing action when the cover is closed from the state in which the cover is opened so as to keep the reciprocating members in the other end position.

According to a fourth aspect of the invention, there is provided an image forming apparatus as set forth in the third aspect of the invention, wherein the position detection unit includes a position sensor for outputting a first state signal when the reciprocating members are disposed in the one end position and outputting a second state signal when the reciprocating members are disposed in a position which lies apart a predetermined amount or more from the one end position.

According to a fifth aspect of the invention, there is provided an image forming apparatus as set forth in the fourth aspect of the invention, including a motor for generating a driving force for shifting the reciprocating member, and a motor driving unit for driving the motor so as to shift the reciprocating members towards the one end position in response to the power supply having been switched on, and wherein the position detection unit detects (indirectly) the position of the displacement members resulting immediately after the power supply has been switched (by detecting the position of the reciprocating members resulting immediately after the power supply has been switched on) on based on the state of an output signal outputted from the position sensor when the power supply has been switched on and a driving time or driving amount of the motor by which the motor has been driven from a point in time at which the motor was started to be driven to a point in time at which the state of the output signal from the position sensor has been switched from the second state to the first state, and wherein the history determination unit determines that a history exists which shows that the cover has been opened and closed in the event that the position of the displacement members detected by the position detection unit is the permitting position.

According to a sixth aspect of the invention, there is provided an image forming apparatus as set forth in the first or second aspect of the invention, including image forming units provided in such a manner as to correspond respectively to a plurality of colors, and a correcting operation executing unit for executing a correcting operation for registering positions where images are formed by the image forming units in the event that the history determination unit determines that a history exists which shows that the cover has been opened and closed.

According to a seventh aspect of the invention, there is provided an image forming apparatus as set forth in the sixth aspect of the invention, wherein the image forming units are process cartridges which are detachably attached in the apparatus main body, and wherein the detachable members are the process cartridges.

According to an eighth aspect of the invention, there is provided an image forming apparatus as set forth in the seventh aspect of the invention, wherein the one-way link mechanism includes reciprocating members provided in such a manner as to reciprocate between one end position and the other end position so that when at the one end position, the reciprocating members place the displacement members in the preventing position, while when at the other end position, the reciprocating members place the displacement members in the permitting position, and a reciprocating member shifting mechanism adapted to be linked with a cover opening action when the cover is opened from a state in which the cover is closed and the reciprocating members are disposed in the one end position so as to shift the reciprocating members from the one end position to the other end position and adapted not to be linked with a cover closing action when the cover is closed from the state in which the cover is opened so as to keep the reciprocating members in the other end position.

According to a ninth aspect of the invention, there is provided an image forming apparatus as set forth in the eighth aspect of the invention, wherein the position detection unit includes a position sensor for outputting a first state signal when the reciprocating members are disposed in the one end position and outputting a second state signal when the reciprocating members are disposed in a position which lies apart a predetermined amount or more from the one end position.

According to a tenth aspect of the invention, there is provided an image forming apparatus as set forth in the ninth aspect of the invention, including a motor for generating a driving force for shifting the reciprocating member, and a motor driving unit for driving the motor so as to shift the reciprocating members towards the one end position in response to the power supply having been switched on, and wherein the position detection unit detects (indirectly) the position of the displacement members resulting immediately after the power supply has been switched (by detecting the position of the reciprocating members resulting immediately after the power supply has been switched on) based on the state of an output signal outputted from the position sensor when the power supply has been switched on and a driving time or driving amount of the motor by which the motor has been driven from a point in time at which the motor was started to be driven to a point in time at which the state of the output signal from the position sensor has been switched from the second state to the first state, and wherein the history determination unit determines that a history exists which shows that the cover has been opened and closed in the event that the position of the displacement members detected by the position detection unit is the permitting position.

According to an eleventh aspect of the invention, there is provided an image forming apparatus as set forth in the ninth or tenth aspect of the invention, wherein the process cartridges each include a photosensitive member on which an electrostatic latent image is formed and a developing member disposed in such a manner as to confront the photosensitive member for developing the electrostatic latent image, and including spacing members provided in the apparatus main body in such a manner as to correspond respectively to the process cartridges and adapted to be shifted by reciprocating movements of the reciprocating members to a spacing position where the developing members are spaced apart from the corresponding photosensitive members and a contact permitting position where the contact of the developing members to the corresponding photosensitive members is permitted.

According to a twelfth aspect of the invention, there is provided an image forming apparatus as set forth in the eleventh aspect of the invention, including a reciprocating members' position control unit for switching the positions of the reciprocating members between a position where all the spacing members are disposed in the spacing position, a position where one of the spacing members is disposed in the spacing position, while the remaining spacing members are position in the contact permitting position, and a position where all the spacing members are disposed in the contact permitting position by controlling the drive of the motor based on the switching of the states of output signals from the position sensor.

According to the first aspect of the invention, the cover is provided on the apparatus main body in such a manner as to be opened and closed. The datable members which can be attached and detached by opening the cover are provided within the apparatus main body. In addition, the displacement members and the one-way link mechanism are provided within the apparatus main body. The displacement members can be displaced to the preventing position and the permitting position. When displaced to the preventing position, the displacement members disrupt the attachment and detachment of the detachable members, while when displaced to the permitting position, the displacement members permit the attachment and detachment of the detachable members. The one-way link mechanism displaces the displacement members from the preventing position to the permitting position when the cover is opened from the state in which the cover is closed and the displacement members are disposed in the preventing position. On the other hand, the one-way link mechanism keeps the displacement members in the permitting position when the cover is closed from the state in which the cover is opened.

When the image forming apparatus is furnished with voltages and currents by the power supply, in response to this, the position detection unit detects the position of the displacement members resulting then. Then, the existence of a history showing the opening and closure of the cover with the power supply left off is determined by the history determination unit based on the position of the displacement members detected by the position detection unit.

In the event that the cover was opened and closed while the power supply was left off, in the state resulting immediately after the power supply is switched on, the displacement members are disposed in the permitting position. Because of this, in the event that the position of the displacement members resulting immediately after the power supply has been switched off is the permitting position, it can be determined that the cover was opened and closed while the power supply was left off. In contrast, in the event that the position of the displacement members resulting immediately after the power supply has been switched off is the preventing position, it can be determined that the cover was not opened and closed while the power supply was left off. Consequently, it becomes possible to determine accurately on the existence of the history showing that the cover was opened and closed while the power supply was left off.

According to the second aspect of the invention, the detachable members can be made to be fixed to the apparatus main body and the fixing of the detachable members to the apparatus main body can be released by the displacement members.

According to the third and eighth aspects of the invention, the one-way link mechanism includes the reciprocating members which can reciprocate. In such a state that the reciprocating members are disposed in the one end position, the displacement members are disposed in the permitting position. Because of this, the displacement members can be displaced to the preventing position and the permitting position in an ensured fashion through reciprocating movements of the reciprocating members between the one end position and the other end position.

In addition, the one-way link mechanism includes further the reciprocating member shifting mechanism. When the cover is opened from the state in which the cover is closed and the reciprocating members are disposed in the one end position, the reciprocating member shifting mechanism shifts the reciprocating members from the one end position to the other end position. In contrast, when the cover is closed from the state in which the cover is opened, the reciprocating member shifting mechanism keeps the reciprocating members in the permitting position. Consequently, the position of the reciprocating members is detected, based on which the position of the displacement members can be detected.

According to the fourth and ninth aspects of the invention, the position detection unit includes the position sensor. The position sensor outputs the first state signal when the reciprocating members are disposed in the one end position, while the position sensor outputs the second state signal when the reciprocating members are disposed in the position which is spaced apart the predetermined amount or more from the one end position. Because of this, it can be determined whether the reciprocating members are disposed in the one end position or in the position which is spaced apart the predetermined amount or more from the one end position based on the states of signals outputted from the position sensor.

According to the fifth and tenth aspects of the invention, the motor is driven in response to the power supply having been switched on, and the reciprocating members are then shifted towards the one end position. In addition, the position detection unit detects the position of the displacement members resulting immediately after the power supply has been switched based on the state of an output signal outputted from the position sensor when the power supply has been switched on and the driving time or driving amount of the motor by which the motor has been driven from the point in time at which the motor was started to be driven to the point in time at which the state of the output signal from the position sensor has been switched from the second state to the first state. Then, in the event that the position of the displacement members resulting immediately after the power supply has been switched on is the permitting position, it is determined that the opening and closure of the cover was implemented with the power supply left off, thereby making it possible to determine accurately on the existence of the history showing the opening and closure of the cover while the power supply was left off.

According to the sixth aspect of the invention, the image forming units are provided in such a manner as to correspond to the plurality of colors so as to form images by developer of corresponding colors. In the event that the cover was opened and closed in such a state that the power supply was left off, the correcting operation to register the positions where the images are formed by the respective image forming units, that is, the color registration correcting operation is carried out. By this, the generation of a color registration error can be prevented in formation of an image occurring after the power supply is switched on. In addition, since no color registration error correcting operation is carried out in the event that the cover was neither opened nor closed, time to be spent from the power supply is switched on until an image is started to be formed can be shortened. Furthermore, the wastage of developer due to wasteful implementation of the color registration error correcting operation can be prevented.

According to the seventh aspect of the invention, the image forming units are the process cartridges. In this configuration, there may occur a case where the process cartridges are attached to and detached from the interior of the apparatus main body by opening the cover. When the process cartridges are attached or detached, there occurs a position error as to the installation position where the process cartridge are installed within the apparatus main body, and in forming an image after the attachment or detachment of the process cartridges, there is caused a fear that a color registration error attributed to the positional error occurs. In the event that the cover was opened and closed with the power supply left off, by implementing the color registration error correcting operation, the occurrence of color registration error attributed to the position error can be prevented.

According to the eleventh aspect of the invention, the process cartridge includes the photosensitive member and the developing member. The developing member is disposed in such a manner as to confront the photosensitive member, so as to develop the electrostatic latent image formed on the photosensitive member. In addition, the spacing members are provided in such a manner as to correspond respectively to the process cartridges within the apparatus main body. Each spacing member is made to move through the reciprocating movements of the reciprocating members between the spacing position where the developing member is spaced apart from the photosensitive member and the contact permitting position where the contact of the developing member with the photosensitive member is permitted. Because of this, the state of the developing member relative to the photosensitive member can be switched between the contact state and spaced apart state.

According to the twelfth aspect of the invention, the position of the reciprocating members is changed by the drive of the motor being controlled based on the switching of states of output signals from the position sensor. Specifically, the positions of the reciprocating members are switched between the position where all the spacing members are disposed in the spacing position, the position where one of the spacing members is disposed in the spacing position, while the remaining spacing members are position in the contact permitting position, and the position where all the spacing members are disposed in the contact permitting position. In this way, the switching of the positions of the reciprocating members can be attained based on output signals from the one position sensor without providing position sensors in such a manner as to correspond respectively to all the respective positions of the reciprocating members.

What is claimed is:

1. An image forming apparatus that is operable in a state in which a power supply unit is switched on, the image forming apparatus comprising;

an apparatus main body;

a detachable member that is detachably provided in the apparatus main body;

a cover that is provided so as to be openable and closable to the apparatus main body, the cover being opened and closed for an attachment and detachment operation of the detachable member;

a displacement member that is provided so as to be movable between a preventing position where the displacement member prevents the attachment and detachment operation of the detachable member and a permitting position where the displacement member permits the attachment and detachment operation of the detachable member;

a one-way link mechanism that is provided in the apparatus main body for displacing the displacement member from the preventing position to the permitting position when the cover is opened from a state in which the cover is closed and the displacement member is disposed in the preventing position, the one-way link mechanism being provided for keeping the displacement member in the permitting position when the cover is closed from a state in which the cover is opened;

a position detection unit for detecting a position of the displacement member right after the power supply unit has been switched on; and a history determination unit for determining an existence of a history showing an opening and closure of the cover while the power supply unit is left off based on the position of the displacement member detected by the position detection unit.

2. The image forming apparatus according to claim 1, wherein the displacement member is a fixing member that is movable between a fixing state in which the fixing member press against the detachable member so as to fix the detachable member to the apparatus main body in such a state that the detachable member is attached in the apparatus main body, and a fixing release state in which the fixing member is separated from the detachable member so as to release the detachable member from the apparatus main body.

3. The image forming apparatus according to claim 1, wherein the one-way link mechanism comprises:

a reciprocating member that is provided so as to reciprocate between a first end position and a second end position, the reciprocating member placing the displacement member in the preventing position when the reciprocating member is disposed at the first end position, the reciprocating member placing the displacement member in the permitting position when the reciprocating member is disposed at the second end position; and a reciprocating member shifting mechanism that is configured to be linked with a cover opening operation so as to shift the reciprocating member from the first end position to the second end position when the cover is opened from a state in which the cover is closed and the reciprocating member is disposed in the first end position, the reciprocating member shifting mechanism configured not to be linked with a cover closing action so as to keep the reciprocating member in the second end position when the cover is closed from the state in which the cover is opened.

4. The image forming apparatus according to claim 3, wherein the position detection unit includes a position sensor for outputting a first state signal when the reciprocating member is disposed in the first end position and outputting a second state signal when the reciprocating member is disposed in a position which lies apart a predetermined amount or more from the first end position.

5. The image forming apparatus according to claim 4, further comprising:

a motor for generating a driving force for shifting the reciprocating member; and a motor driving unit for driving the motor so as to shift the reciprocating member towards the first end position in response to the power supply unit having been switched on, and wherein the position detection unit detects the position of the displacement member right after the power supply has been switched on based on a state of an output signal outputted from the position sensor when the power supply has been switched on and a driving time or driving amount of the motor by which the motor is driven from a point in time at which the motor is started to be driven to a point in time at which the state of the output signal from the position sensor is switched from the second state to the first state, and wherein the history determination unit determines that a history exists which shows that the cover has been opened and closed when the position of the displacement member detected by the position detection unit is the permitting position.

6. The image forming apparatus according to claim 1, further comprising:

a plurality of image forming units, each of the image forming units provided so to correspond to a plurality of colors, respectively, the each of image forming units provided for forming an image by developing agent of a respective one of the colors; and a correcting operation executing unit for executing a correcting operation for registering positions where images are formed by the image forming units when the history determination unit determines that a history exists which shows that the cover has been opened and closed.

7. The image forming apparatus according to claim 6, wherein the image forming units are process cartridges which are detachably attached in the apparatus main body, and wherein the detachable member is the process cartridge.

8. The image forming apparatus as set forth in claim 7, wherein the one-way link mechanism comprises:

a reciprocating member that is provided so as to reciprocate between a first end position and a second end position, the reciprocating member placing the displacement member in the preventing position when the reciprocating member is disposed at the first end position, the reciprocating member placing the displacement member in the permitting position when the reciprocating member is disposed at the second end position; and a reciprocating member shifting mechanism that is configured to be linked with a cover opening operation so as to shift the reciprocating member from the first end position to the second end position when the cover is opened from a state in which the cover is closed and the reciprocating member is disposed in the first end position, the reciprocating member shifting mechanism configured not to be linked with a cover closing action so as to keep the reciprocating member in the second end position when the cover is closed from the state in which the cover is opened.

9. The image forming apparatus according to claim 8, wherein the position detection unit includes a position sensor for outputting a first state signal when the reciprocating member is disposed in the first end position and outputting a second state signal when the reciprocating member is disposed in a position which lies apart a predetermined amount or more from the first end position.

10. The image forming apparatus according to claim 9, further comprising:

a motor for generating a driving force for shifting the reciprocating member; and a motor driving unit for driving the motor so as to shift the reciprocating member towards the first end position in response to the power supply unit having been switched on, and wherein the position detection unit detects the position of the displacement member right after the power supply has been switched on based on a state of an output signal outputted from the position sensor when the power supply has been switched on and a driving time or driving amount of the motor by which the motor is driven from a point in time at which the motor is started to be driven to a point in time at which the state of the output signal from the position sensor is switched from the second state to the first state, and wherein the history determination unit determines that a history exists which shows that the cover has been opened and closed when the position of the displacement member detected by the position detection unit is the permitting position.

11. The image forming apparatus according to claim 10, wherein each of the process cartridges comprises a photosensitive member on which an electrostatic latent image is formed and a developing member disposed so as to confront the photosensitive member for developing the electrostatic latent image, and the image forming apparatus further including:

a plurality of spacing members provided in the apparatus main body, each of the spacing members provided so as to correspond to the process cartridges, respectively, the spacing member configured to be movable between a spacing position where the developing member is spaced apart from the corresponding photosensitive member and a contact permitting position where the contact of the developing member to the corresponding photosensitive member is permitted by a reciprocating movement of the reciprocating member.

12. The image forming apparatus according to claim 11, further comprising, a reciprocating member position control unit for switching a position of the reciprocating member between a position where all the spacing members are disposed in the spacing position, a position where one of the spacing members is disposed in the spacing position, while the remaining spacing members are position in the contact permitting position, and a position where all the spacing members are disposed in the contact permitting position by controlling a drive of the motor based on a switching of the states of output signals from the position sensor.

* * * * *